US007524009B2

(12) United States Patent
Chiwata

(10) Patent No.: US 7,524,009 B2
(45) Date of Patent: Apr. 28, 2009

(54) IMAGE RECORDING METHOD AND IMAGE RECORDING APPARATUS

(75) Inventor: Yuhei Chiwata, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 580 days.

(21) Appl. No.: 11/385,897

(22) Filed: Mar. 22, 2006

(65) Prior Publication Data

US 2006/0214960 A1 Sep. 28, 2006

(30) Foreign Application Priority Data

Mar. 23, 2005 (JP) ..... 2005-084556

(51) Int. Cl.
*B41J 2/205* (2006.01)

(52) U.S. Cl. ..... 347/15; 347/19; 358/3.02

(58) Field of Classification Search ..... 347/15, 347/12, 43, 19, 13, 42; 358/1.2, 1.9, 3.02–3.06
See application file for complete search history.

(56) References Cited

U.S. PATENT DOCUMENTS 5,528,270 A 6/1996 Tajika et al.
5,946,006 A 8/1999 Tajika et al.
6,352,329 B1 * 3/2002 Watanabe et al. ..... 347/15
7,431,426 B2 * 10/2008 Yamaguchi et al. ..... 347/40
2004/0104951 A1 6/2004 Shibata et al.

FOREIGN PATENT DOCUMENTS

JP 5-69545 A 3/1993
JP 2004-58282 A 2/2004

* cited by examiner

*Primary Examiner*—Lamson D Nguyen
(74) *Attorney, Agent, or Firm*—Birch, Stewart, Kolasch & Birch, LLP

(57) ABSTRACT

The image recording apparatus records an image by ejecting ink onto a recording medium from a print head having a plurality of nozzles while moving the print head and the recording medium relatively to each other. The image recording apparatus comprises: a memory device which stores reference density characteristics obtained by measuring a prescribed test pattern formed on the recording medium by means of the nozzles; a density characteristic acquiring device which acquires density characteristics of print areas corresponding to the nozzles; a compensation device which compensates a droplet ejection rate signal of each of the nozzles so that the density characteristics acquired by the density characteristic acquiring device coincide with the reference density characteristics; and a quantization device which quantizes each droplet ejection rate signal compensated by the compensation device.

7 Claims, 35 Drawing Sheets

IMAGE RECORDING METHOD AND IMAGE RECORDING APPARATUS

BACKGROUND OF THE INVENTION

1. Field of the Invention

The present invention relates to an image recording method and an image recording apparatus, and more particularly, to technology for compensating non-uniformity in density caused by an image recording apparatus which records an image by forming dots on a recording medium.

2. Description of the Related Art

As an image recording apparatus, an inkjet recording apparatus (inkjet printer) is known, which comprises an ink ejection apparatus having an inkjet head (recording head) with a plurality of arranged nozzles (ejection elements), for example. According to such an image recording apparatus, images are formed on a recording medium by ejecting ink from the nozzles toward the recording medium while the inkjet head and the recording medium are caused to be moved relatively to each other.

In an inkjet recording apparatus of this kind, there is a possibility that one-dimensional non-uniformity may arises due to errors in the print characteristics (ejection characteristics) of each nozzle. In particular, in a full-line head which is capable of recording images over the full surface of a recording paper simply by performing one operation of moving the recording paper and the head relatively to each other (by performing a single-pass), the print characteristics of the nozzles are reflected directly on the recording paper. Therefore, linear non-uniformity in the conveyance direction of the recording paper is readily noticeable.

For example, as shown in FIG. 29A, an image is recorded by forming ink dots 908 on the recording paper 904 by ejecting ink droplets 906 from nozzles 902, while a recording paper 904 is conveyed with respect to a line type recording head 900 having nozzles 902 arranged in one row, in a direction substantially perpendicular to the nozzle arrangement direction (in the direction indicated by the arrow in FIG. 29A).

In this case, if, of the ink droplets 906 ejected from the nozzles 902, there is an ink droplet 906*a* having a displaced landing position, or an ink droplet 906*b* having a greater ejection volume than that under normal conditions, then a white stripe 910, a black stripe 912 of increased density, and the like, appear on the recording paper 904, thus giving rise to non-uniformity in density. As a result, linear non-uniformity appears on the recording paper 904, as shown in FIG. 29B, and this might become a problem in terms of image quality.

In this way, errors in the ejection volume or errors in the landing position in the direction perpendicular to the conveyance direction of the recording paper, lead to band-shaped lines due to the non-uniformity in density in the conveyance direction of the recording paper.

In view of such non-uniformity in density, a number of technologies have been proposed in which errors in the print characteristics of the nozzles are measured in advance and then non-uniformity in density is compensated on the basis of the errors thus measured.

Broadly speaking, two types are known as such techniques for compensating non-uniformity of density.

The first type of method should be called a physical compensation method. This method adjusts the ejection volume to a target value, by controlling the drive waveform, and the like, according to the errors in the ejection volume, and adjusts the ink-landing position to a target position by controlling the flight direction of the ejected ink, and the like, according to errors in the landing position.

Furthermore, the other type should be called a visual compensation method. This method adjusts the density within a region of a certain surface area, to a target density value, by controlling the image signal to adjust the droplet ejection rate, and thereby non-uniformity of density is compensated.

For example, a method is known in which, a solid image having non-uniformity is created as a test chart in order to compensate non-uniformity of density arising principally from ejection volume errors after optically reading in non-uniformity of density, the density characteristics of nozzles are measured by optically scanning this chart, and the droplet ejection rate is compensated so that the density characteristics of the nozzles conform to target values (see, for example, Japanese Patent Application Publication No. 5-69545).

Furthermore, in order to compensate linear non-uniformity caused by landing position errors, a method is known in which, firstly, landing position error information for each nozzle is acquired on the basis of a special test pattern, whereupon the density characteristics of the print area corresponding to a certain nozzle are estimated on the basis of the effect of the landing position errors of the surrounding nozzles (the effect of the deviation of the landing positions of the adjacent nozzles), and then the compensation is performed on the basis of the density characteristics thus estimated (see, for example, Japanese Patent Application Publication No. 2004-58282).

However, in the related art technology described above, it is difficult to completely compensate the linear non-uniformity caused by landing position errors. This is described in more detail below with reference to the drawings.

For example, in the case of a recording paper (media) 904 and a (line type) recording head 900 are disposed as shown in FIG. 30, Di represents the region (print area) on the recording paper 904 covered by the i-th nozzle 902*i*. The optical density of the print area Di corresponding to each nozzle 902*i* is measured while an optical sensor 920 is successively conveyed on the nozzle pitch basis, in the direction indicated by the arrow in FIG. 30. In this case, the aperture diameter of the optical sensor 920 in the scanning direction corresponds to the nozzle pitch.

For example, in Japanese Patent Application Publication No. 5-69545, a test pattern is printed and the optical density with respect to each area is measured, thereby acquiring the density characteristics of the nozzles. Furthermore, in Japanese Patent Application Publication No. 2004-58282, the nozzle characteristics are measured in advance, and then the density characteristics of the each area are estimated from the dot shape.

Here, a case shall be considered in which there is an error in the ejection volume of the i-th nozzle 902*i*, for example. As shown in FIG. 31, it is supposed that a dot 908*i* having a larger than ideal size is ejected from the i-th nozzle 902*i*. If the dot size becomes large in this way, then the density value which is obtained by measuring the density with the optical sensor 920 also increases, and the density of the regions where the dots 908*i* are ejected and hit becomes higher in comparison with the ideal value.

In this case, if the density measurement as described in Japanese Patent Application Publication No. 5-69545 is carried out, the density characteristics of the area corresponding to each nozzle (the micro density characteristics D) are shown on the graph on the right-hand side of FIG. 31. In other words, the measurement shows that the density of the area Di covered by the i-th nozzle 902*i* increases. In this case, it is possible to (physically) compensate the actual ejection volume by controlling the drive force on the basis of the measured density characteristics according to a method described in Japanese Patent Application Publication No. 5-69545, thereby compensating the non-uniformity of density. As a result, a flat graph of density measurement values as shown on the right-hand side of FIG. 32 can be obtained.

Furthermore, in this case, for example, a visual compensation is carried out by omitting the droplet ejection from the i-th nozzle 902*i* once in every five times in such a manner that the droplet ejection rate of the i-th nozzle 902*i* is controlled to 4/5 as shown in FIG. 33, and thereby it is also possible to suppress the density of the area Di covered by the i-th nozzle 902*i* and to obtain a flat density measurement graph as shown on the right-hand side of FIG. 33. Furthermore, in the method described in Japanese Patent Application Publication No. 2004-58282, it is possible to perform the similar compensation. In this way, according to the related art, it is possible to compensate non-uniformity of density arising from errors in the ejection volume of nozzles.

However, as described below, in the related art, there is a possibility that it is difficult to compensate non-uniformity of density caused by ink-landing position errors of the nozzles.

Here, a case where the dot diameter is smaller than the nozzle pitch as shown in FIG. 34 is described. For example, in cases where droplets are ejected to form small dots in a low-density region by a multiple-value inkjet printer capable of ejecting droplets to form dots of a plurality of dot sizes, droplets are ejected to form dots having a smaller dot diameter than the nozzle pitch in this way.

Here, a case where there is an ink-landing position error of the i-th nozzle 902*i* is described. More specifically, as shown in FIG. 34, the dots 908*i* ejected by the i-th nozzle 902*i* are displaced from the ideal droplet ejection positions indicated by the dotted line.

In this case, although the dots 908*i* formed by droplets ejected from the i-th nozzle 902*i* are displaced from the ideal landing positions as shown in FIG. 34, they are still located in the area Di covered by the i-th nozzle 902*i* and there is no change in the overall amount of coloring material inside this area Di. Hence, if the density is measured by the optical sensor 920 described above, then an even result of the density measurement is obtained with respect to the density characteristics of each nozzle, as in the graph shown on the right-hand side in FIG. 34. Thus the measurement show that there is no non-uniformity in density, and it is therefore difficult to carry out the compensation of the non-uniformity in density.

However, if the sample shown in FIG. 34 is viewed by a human observer with the naked eye, then the displacements are visible as linear non-uniformity. On the other hand, in the above-described related methods for compensating non-uniformity of density, a problem of this kind is not taken into account, and therefore it is difficult to carry out the sufficient compensation and such methods are not particularly effective with respect to non-uniformity of density arising from landing position errors.

The resolution of the optical sensor is equal to the nozzle resolution (the reciprocal of the nozzle pitch) in the examples described above; however, if the resolution of the optical sensor is set to a higher resolution, then it is possible to detect non-uniformity of density even in cases such as that shown in FIG. 34, in principle. For example, if the resolution of the optical sensor is doubled as shown in FIG. 35 and the measurement is carried out under the situation where the area Di covered by each nozzle 902*i* is divided into two parts, then a graph indicating density characteristics is obtained as shown on the right-hand side in FIG. 35, and hence the non-uniformity of density can be detected.

However, the density characteristics obtained in this way fluctuate in a range smaller than the nozzle pitch which is the smallest possible control unit. Hence, according to the non-uniformity of density compensation methods of the related art such as those described in Japanese Patent Application Publication Nos. 5-69545 and 2004-58282, it is difficult to compensate non-uniformity of density arising from ink-landing position errors as shown in FIG. 34.

It is not limited to the cases where the dot diameter is smaller than the nozzle pitch in this way. In general, there are cases where the dot diameter is larger than the nozzle pitch; however, the essence of the problems in these cases is the same as that described above. Hence, in such cases, it is also difficult to compensate non-uniformity of density which arises from ink-landing position errors.

In these cases, if the density characteristics are measured according to the method as described above, then a density variation depending on the surface area of the portion of the dot 908*i* which projects into the print area of the adjacent nozzle as shown in FIG. 36, for example, is measured as the density characteristics of each print area Di, and the corresponding nozzle is considered as a subject for the compensation. Here, the surface area of the portion of the dot which does not project into the adjacent print area is taken not to be a subject for the compensation, but in fact, it is distributed in an uneven fashion within the print area Di, for example, it is weighted toward the bottom within the print area Di, as shown in FIG. 37. Therefore this can become a cause of non-uniformity in density. However, according to the related art described above, this factor is not taken into account, and therefore the compensation may not be complete.

SUMMARY OF THE INVENTION

The present invention has been contrived in view of the aforementioned circumstances, an object thereof being to provide an image recording method and an image recording apparatus capable of compensating non-uniformity of density arising from a landing position error.

In order to attain the aforementioned object, the present invention is directed to an image recording apparatus which records an image by ejecting ink onto a recording medium from a print head having a plurality of nozzles while moving the print head and the recording medium relatively to each other, the image recording apparatus comprising: a memory device which stores reference density characteristics obtained by measuring a prescribed test pattern formed on the recording medium by means of the nozzles; a density characteristic acquiring device which acquires density characteristics of print areas corresponding to the nozzles; a compensation device which compensates a droplet ejection rate signal of each of the nozzles so that the density characteristics acquired by the density characteristic acquiring device coincide with the reference density characteristics; and a quantization device which quantizes each droplet ejection rate signal compensated by the compensation device.

According to this aspect of the invention, it is possible to reduce non-uniformity of density, such as linear non-uniformity, by compensating the droplet ejection rate signal in a suitable fashion.

Preferably, if a landing position error occurs in the print area corresponding to a particular nozzle of the nozzles, then each droplet ejection rate signal is compensated so as to reduce a droplet ejection rate in respect of the nozzle corresponding to the print area having the density characteristics which increase due to effect of the landing position error and increase a droplet ejection rate in respect of the nozzle corresponding to the print area having the density characteristics which decrease due to effect of the landing position error, so that non-uniformity of density caused by the landing position error is reduced.

According to this, it is possible to suitably reduce landing position errors, and hence non-uniformity of density can be compensated.

Preferably, the density characteristic acquiring device includes: an acquisition device which acquires density data at a resolution of a real number times as high as a nozzle resolution of the nozzles, the real number being at least two; a filtering process device which carries out a filtering process with respect to the density data acquired by the acquisition device; and an averaging process device which averages the density data filtered by the filtering process device.

According to this, it is possible to compensate non-uniformity arising from landing position errors, to a high degree of accuracy.

Preferably, the filtering process device carries out the filtering process with a low-pass filter having a cut-off frequency of substantially equal to the nozzle resolution.

According to this, it is possible to compensate non-uniformity arising from landing position errors, to a high degree of accuracy.

In order to attain the aforementioned object, the present invention is also directed to An image recording apparatus which is capable of changing a dot size of each of dots formed by a plurality of nozzles when an image is recorded by ejecting ink onto a recording medium from a print head having the nozzles while moving the print head and the recording medium relatively to each other, the image recording apparatus comprising: a memory device which stores reference density characteristics with respect to each dot size which are previously obtained by measuring a prescribed test pattern formed on the recording medium by means of the nozzles; a density characteristic acquiring device which acquires density characteristics of print areas corresponding to the nozzles, with respect to each dot size; a compensation device which compensates a droplet ejection rate signal of each of the nozzles so that the density characteristics acquired by the density characteristic acquiring device coincide with the reference density characteristics, with respect to each dot size; and a quantization device which quantizes each droplet ejection rate signal which is compensated by the compensation device.

According to this aspect of the invention, it is possible to compensate different landing position errors corresponding to different dot sizes, in a suitable fashion.

In order to attain the aforementioned object, the present invention is also directed to an image recording method of recording an image by ejecting ink onto a recording medium from a print head having a plurality of nozzles while moving the print head and the recording medium relatively to each other, the image recording method comprising the steps of: storing reference density characteristics obtained by measuring a prescribed test pattern formed on the recording medium by means of the nozzles; acquiring density characteristics of print areas corresponding to the nozzles; compensating a droplet ejection rate signal of each of the nozzles so that the acquired density characteristics of the print areas corresponding to the nozzles coincide with the reference density characteristics; and quantizing the compensated droplet ejection rate signal.

According to this aspect of the invention, it is possible to reduce non-uniformity of density, such as linear non-uniformity, in a suitable fashion by compensating the droplet ejection rate signal.

Preferably, the density characteristics of the print areas corresponding to the nozzles are calculated by measuring density data at a resolution of a real number times as high as a nozzle resolution of the nozzles, the real number being at least two, filtering the measured density data, and then averaging the filtered density data.

According to this, it is possible to compensate non-uniformity arising from landing position errors, to a high degree of accuracy.

As described above, according to the image recording method and apparatus relating to the present invention, it is possible to satisfactorily eliminate non-uniformity of density, such as linear non-uniformity, by compensating the droplet ejection rate signal.

BRIEF DESCRIPTION OF THE DRAWINGS

The nature of this invention, as well as other objects and advantages thereof, will be explained in the following with reference to the accompanying drawings, wherein.

DETAILED DESCRIPTION OF THE PREFERRED EMBODIMENTS

Figure 1:
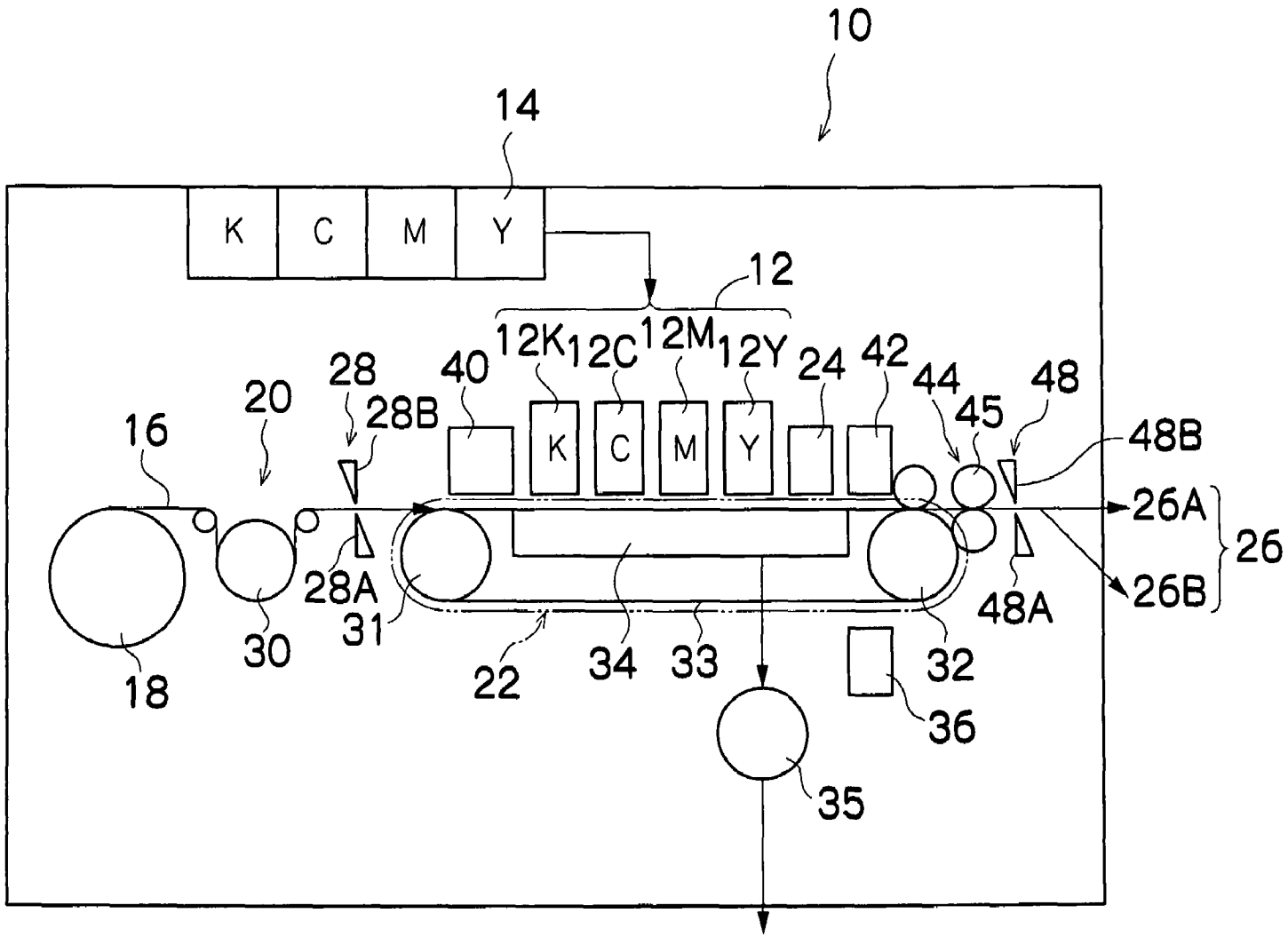
FIG. 1 is a general schematic drawing of one embodiment of an inkjet recording apparatus forming an image forming apparatus according to the present invention.

FIG. 1 is a general schematic drawing of an embodiment of an inkjet recording apparatus which forms an image recording apparatus relating to the present invention.

As shown in FIG. 1, the inkjet recording apparatus 10 comprises: a print unit 12 having a plurality of print heads (liquid ejection heads) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a belt conveyance unit 22 disposed facing the nozzle face (ink-droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite to the curl direction in the magazine. At this time, the heating temperature is preferably controlled in such a manner that the recording paper 20 has a curl in which the surface on which the print is to be made is slightly rounded in the outward direction.

The decurled and cut recording paper 16 is delivered to the belt conveyance unit 22. The belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the print unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different from that of the belt 33 to improve the cleaning effect.

The inkjet recording apparatus 10 can comprise a roller nip conveyance mechanism, in which the recording paper 16 is pinched and conveyed with nip rollers, instead of the belt conveyance unit 22. However, there is a possibility in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the print unit 12 in the conveyance pathway formed by the belt conveyance unit 22. The heating fan 40 blows heated air onto the recording paper 16 to heat the recording paper 16 immediately before printing so that the ink deposited on the recording paper 16 dries more easily.

Figure 2:
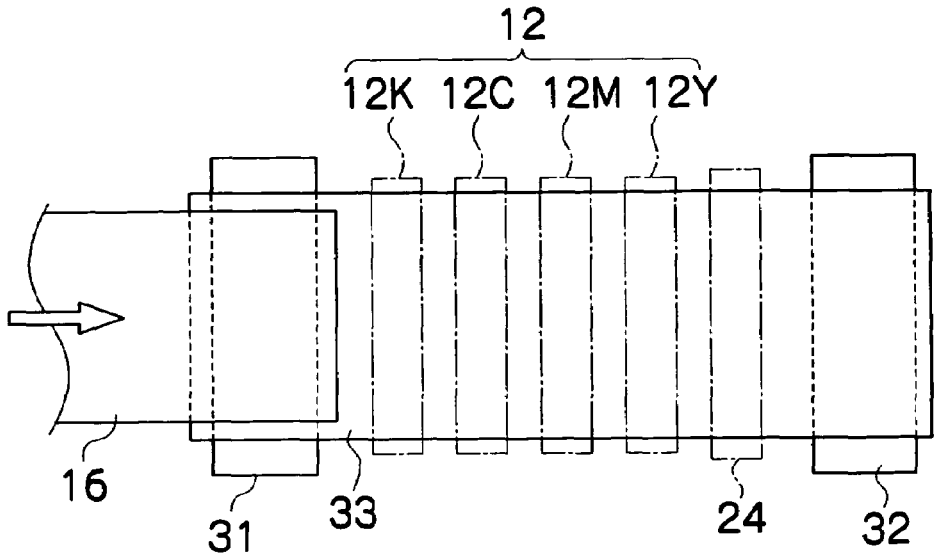
FIG. 2 is a plan view of the principal part of the peripheral area of a print unit in the inkjet recording apparatus illustrated in FIG. 1.

FIG. 2 is a principal plan diagram showing the periphery of the print unit 12 in the inkjet recording apparatus 10.

As shown in FIG. 2, the print unit 12 is a so-called "full line head" in which a line head having a length corresponding to the maximum paper width is arranged in a direction (main scanning direction) that is perpendicular to the paper conveyance direction (sub-scanning direction).

The print heads 12K, 12C, 12M and 12Y are constituted by full line heads in which a plurality of ink ejection ports (nozzles) are arranged through a length exceeding at least one side of the maximum size of the recording paper 16 intended for use with the inkjet recording apparatus 10.

The print heads 12K, 12C, 12M, and 12Y are arranged in the order of black (K), cyan (C), magenta (M), and yellow (Y) from the upstream side (left side in FIG. 1), in the conveyance direction of the recording paper 16 (paper conveyance direction). A color image can be formed on the recording paper 16 by ejecting the inks from the print heads 12K, 12C, 12M, and 12Y, respectively, onto the recording paper 16 while the recording paper 16 is conveyed.

The print unit 12, in which full-line heads covering the entire width of the paper are thus provided for each of the ink colors, can record an image over the entire surface of the recording paper 16 by performing a single pass, namely, one action of moving the recording paper 16 and the print unit 12 relatively to each other in the paper conveyance direction (sub-scanning direction) (in other words, by means of a single sub-scan). Higher-speed printing is thereby made possible and productivity can be improved in comparison with a shuttle type head configuration in which a recording head moves reciprocally in a direction (main scanning direction) which is substantially perpendicular to the paper conveyance direction (sub-scanning direction).

The terms "main scanning direction" and "sub-scanning direction" here are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning, while the full-line head and the recording paper are moved relatively to each other. The direction in which sub-scanning is performed is called the sub-scanning direction. Consequently, the conveyance direction of the recording paper is the sub-scanning direction and the direction perpendicular to the sub-scanning direction is called the main scanning direction.

Although a configuration with four standard colors, K M C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the print heads 12K, 12C, 12M, and 12Y, and the tanks are respectively connected to the print heads 12K, 12C, 12M, and 12Y by means of channels (not shown). The ink storing and loading unit 14 has a warning device (for example, a display device, an alarm sound generator, or the like) for warning when the remaining amount of any ink is low, and has a mechanism for preventing loading errors among the colors.

The print determination unit 24 has an image sensor (line sensor) for capturing an image of the ink-droplet deposition result of the print unit 12, and functions as a device to check for ejection defects such as clogs of the nozzles in the print unit 12 from the ink-droplet deposition results evaluated by the image sensor. Furthermore, with the aim of compensating non-uniformity of density, as described later, the print determination unit 24 is used to optically measure the density profile of the test pattern, in order to acquire the micro density characteristics, which are the density characteristics of the areas corresponding to the nozzles.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row including photoelectric transducing elements (pixels) arranged in a line provided with an R filter, a green (G) sensor row with a G filter, and a blue (B) sensor row with a B filter. Instead of a line sensor, it is possible to use an area sensor including photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the judgment of the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substances that cause dye molecules to break down, and thereby the effect of increasing the durability of the print is brought.

A heating/pressurizing unit 44 is disposed following the post-drying unit 42. The heating/pressurizing unit 44 is a device to control the glossiness of the image surface. The image surface is pressed with a pressure roller 45 having a predetermined uneven surface shape while the image surface is heated, and thereby the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown, the paper output unit 26A for the target prints is provided with a sorter for collecting prints according to print orders.

Figure 3:
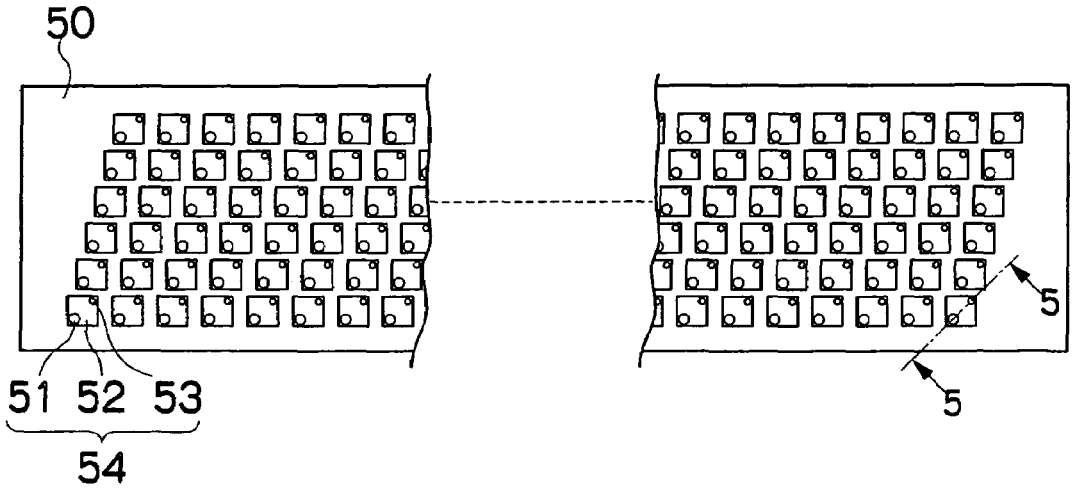
FIG. 3 is a plan perspective diagram showing an example of the structure of a print head.

Next, the arrangement of nozzles (liquid ejection ports) in the print head (liquid ejection head) will be described. The print heads 12K, 12C, 12M and 12Y provided for the respective ink colors have the same structure, and a print head representing these print heads is indicated by the reference numeral 50. FIG. 3 shows a plan view perspective diagram of the print head 50.

As shown in FIG. 3, the print head 50 according to the present embodiment achieves a high density arrangement of nozzles 51 by adopting a two-dimensional staggered matrix array of pressure chamber units 54. Each of the pressure chamber units 54 includes a nozzle for ejecting ink as ink droplets, a pressure chamber 52 for applying pressure to the ink in order to eject ink, and an ink supply port 53 for supplying ink to the pressure chamber 52 from a common liquid chamber (not shown in FIG. 3).

In the example shown in FIG. 3, the pressure chambers 52 each have an approximately square planar shape when viewed from above, but the planar shape of the pressure chambers 52 is not limited to a square shape. As shown in FIG. 3, a nozzle 51 is formed at one end of a diagonal of each pressure chamber 52, and an ink supply port 53 is provided at the other end thereof.

Figure 4:
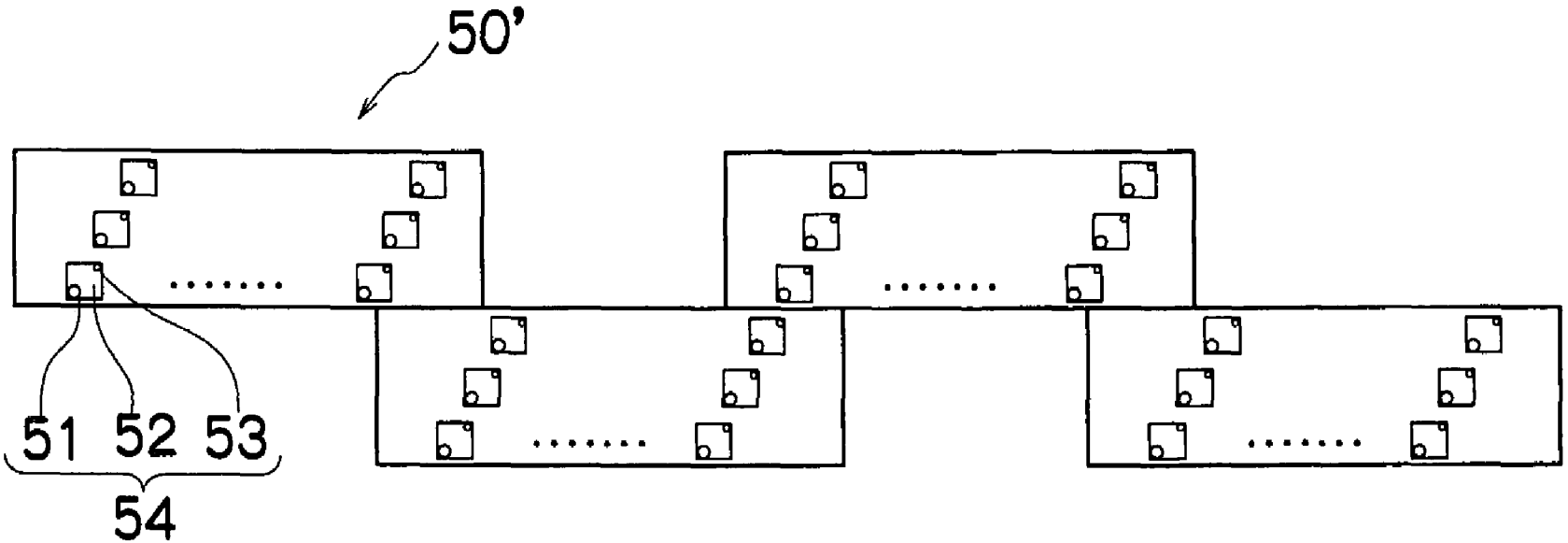
FIG. 4 is a plan view showing a further example of a print head.

Moreover, FIG. 4 is a plan view perspective diagram showing a further example of the structure of a print head. As shown in FIG. 4, one long full line head may be constituted by combining a plurality of short heads 50' arranged in a two-dimensional staggered array, in such a manner that the combined length of this plurality of short heads 50' corresponds to the full width of the print medium.

Figure 5:
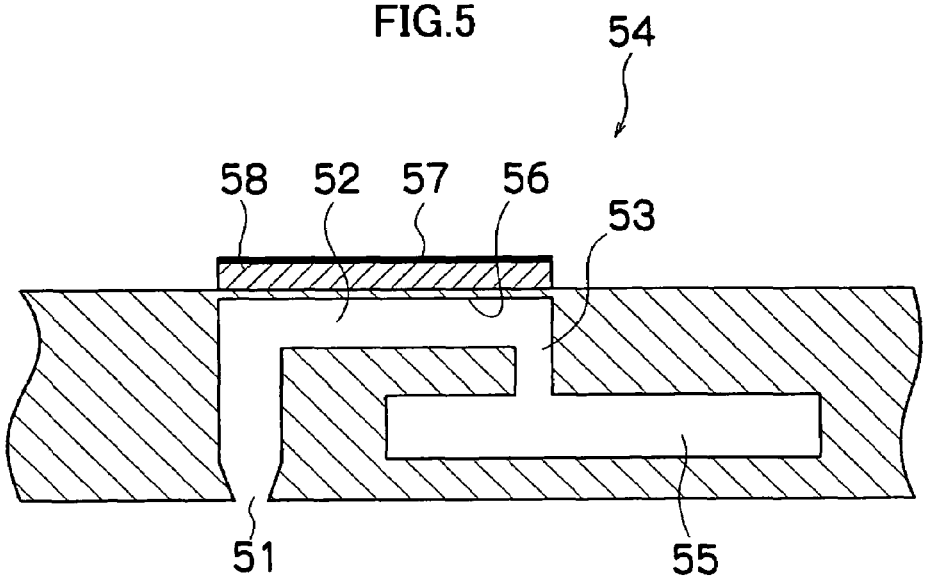
FIG. 5 is a cross-sectional diagram along line 5-5 in FIG. 3.

Furthermore, FIG. 5 shows a cross-sectional diagram along line 5-5 in FIG. 3.

As shown in FIG. 5, each pressure chamber unit 54 is formed by a pressure chamber 52 which is connected to a nozzle 51 that ejects ink, a common flow chamber 55 for supplying ink via a supply port 53 is connected to the pressure chamber 52, and one surface of the pressure chamber 52 (the ceiling in the diagram) is constituted by a diaphragm 56. A piezoelectric element 58 which deforms the diaphragm 56 by applying pressure to the diaphragm 56 is bonded to the upper part of same, and an individual electrode 57 is formed on the upper surface of the piezoelectric element 58. Furthermore, the diaphragm 56 also serves as a common electrode.

The piezoelectric element 58 is sandwiched between the common electrode (diaphragm 56) and the individual electrode 57, and it deforms when a drive voltage is applied to these two electrodes 56 and 57. The diaphragm 56 is pressed by the deformation of the piezoelectric element 58, in such a manner that the volume of the pressure chamber 52 is reduced and ink is ejected from the nozzle 51. If the voltage applied between the two electrodes 56 and 57 is released, then the piezoelectric element 58 returns to its original position, the volume of the pressure chamber 52 returns to its original size, and new ink is supplied into the pressure chamber 52 from the common liquid channel 55 and via the supply port 53.

Figure 6:
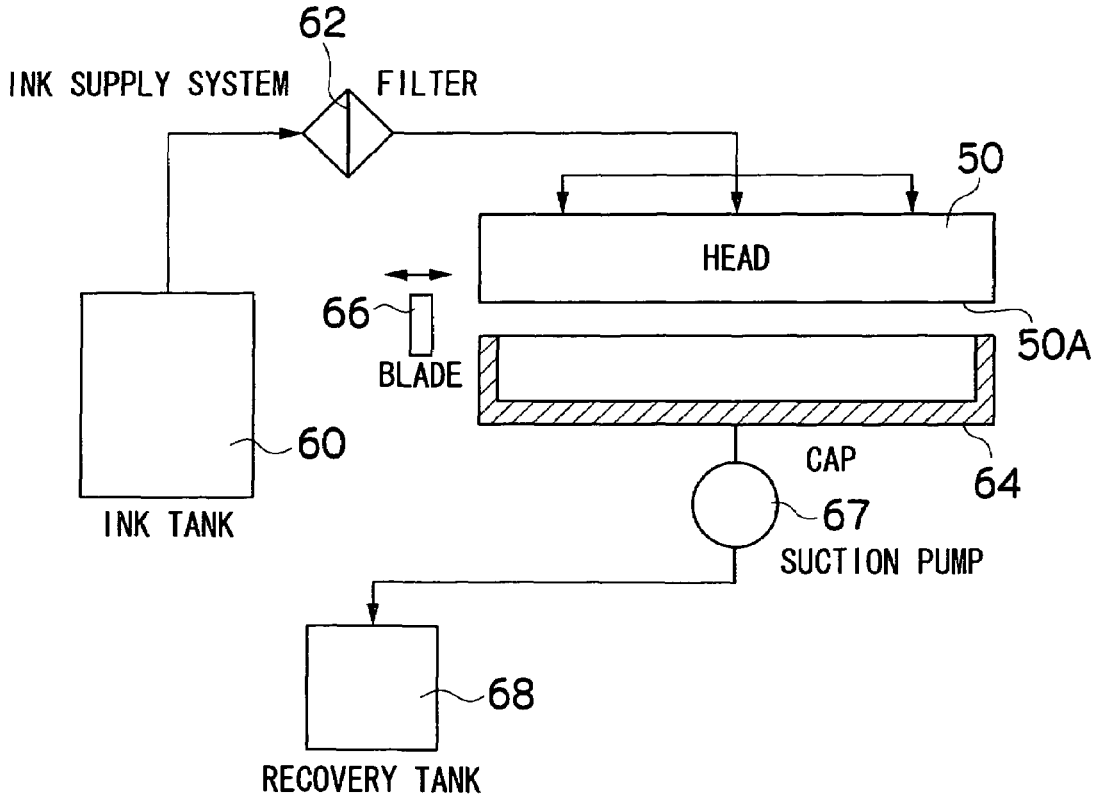
FIG. 6 is a schematic drawing showing the composition of an ink supply system in the inkjet recording apparatus according to the embodiment.

FIG. 6 is a schematic drawing showing the configuration of the ink supply system in the inkjet recording apparatus 10. The ink tank 60 is a base tank that supplies ink to the print head 50 and is set in the ink storing and loading unit 14 described with reference to FIG. 1. The types of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 6 is equivalent to the ink storing and loading unit 14 in FIG. 1 described above.

A filter 62 for removing foreign matters and bubbles is disposed in the middle of the channel connecting the ink tank 60 and the print head 50 as shown in FIG. 6. The filter mesh size in the filter 62 is preferably equivalent to or less than the diameter of the nozzle of the print head 50 and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

Furthermore, the inkjet recording apparatus 10 is also provided with a cap 64 as a device to prevent the nozzles 51 from drying out and to prevent an increase in the ink viscosity in the vicinity of the nozzles, and a cleaning blade 66 forming a device which cleans the nozzle surface (ink ejection surface) 50A of the print head 50 on which the nozzles 51 are formed.

A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced upward and downward in a relative fashion with respect to the print head 50 by an elevator mechanism (not shown). When the power of the inkjet recording apparatus 10 is switched off or when the apparatus is in a standby state for printing, the elevator mechanism raises the cap 64 to a predetermined elevated position so as to come into close contact with the print head 50, and the nozzle region of the nozzle surface 50A is thereby covered by the cap 64.

The cleaning blade 66 is composed of rubber or another elastic member, and can slide on the nozzle surface 50A of the print head 50 by means of a blade movement mechanism (not shown). If there are ink droplets or foreign matter adhering to the nozzle surface 50A, then the nozzle surface 50A is wiped by causing the cleaning blade 66 to make contact with the nozzle surface 50A and slide over same, thereby cleaning the nozzle surface 50A.

During printing or during standby, if the use frequency of a particular nozzle 51 has declined and the ink viscosity in the vicinity of the nozzle 51 has increased, then a preliminary ejection is performed toward the cap 64, in order to remove the ink that has degraded as a result of increasing in viscosity.

Also, when bubbles have become intermixed in the ink inside the print head 50 (the ink inside the pressure chambers 52), the cap 64 is placed on the print head 50, ink (ink in which bubbles have become intermixed) inside the pressure chambers 52 is removed by suction with a suction pump 67, and the ink removed by suction is sent to a recovery tank 68. This suction operation is also carried out in order to suction and remove degraded ink which has hardened due to increasing in viscosity when ink is loaded into the print head for the first time, and when the print head starts to be used after having been out of use for a long period of time.

In other words, when a state in which ink is not ejected from the print head 50 continues for a certain amount of time or longer, the ink solvent in the vicinity of the nozzles 51 evaporates and the ink viscosity increases. In such a state, ink can no longer be ejected from the nozzles 51 even if the piezoelectric elements 58 (see FIG. 5) for driving ejection are operated. Therefore, before reaching such a state, the piezoelectric elements 58 are operated toward an ink receptacle (in a viscosity range that allows ejection by the operation of the piezoelectric elements 58), and a preliminary ejection is performed which causes the ink in the vicinity of the nozzles, which has increased in viscosity, to be ejected. Furthermore, after cleaning away soiling on the surface of the nozzle surface 50A by means of a wiper, such as a cleaning blade 66, provided as a cleaning device on the nozzle surface 50A, a preliminary ejection is also carried out in order to prevent infiltration of foreign matter into the nozzles 51 due to the rubbing action of the wiper. The preliminary ejection is also referred to as "dummy ejection", "purge", "liquid ejection", and so on.

When bubbles have become intermixed in the nozzle 51 or the pressure chamber 52, or when the ink viscosity inside the nozzle 51 has increased over a certain level, ink can no longer be ejected by the preliminary discharge, and therefore a suctioning action is carried out as above.

More specifically, when bubbles have become intermixed into the ink inside the nozzles 51 and the pressure chambers 52 or when the ink viscosity inside the nozzle 51 has increased to a certain level or higher, ink can no longer be ejected from the nozzles even if the piezoelectric elements 58 are operated. In a case of this kind, a cap 64 is placed on the nozzle surface 50A of the print head 50, and the ink containing air bubbles or the ink of increased viscosity inside the pressure chambers 52 is suctioned by a pump 67.

However, this suction action is performed with respect to all of the ink in the pressure chambers 52, and therefore the amount of ink consumption is considerable. Consequently, it is desirable that a preliminary ejection is carried out, if possible, while the increase in viscosity is still minor. The cap 64 illustrated in FIG. 6 functions as a suctioning device and it may also function as an ink receptacle for preliminary ejection.

Moreover, desirably, the inside of the cap 64 is divided by means of partitions into a plurality of areas corresponding to the nozzle rows, thereby achieving a composition in which suction can be performed selectively in each of the demarcated areas, by means of a selector, or the like.

Figure 7:
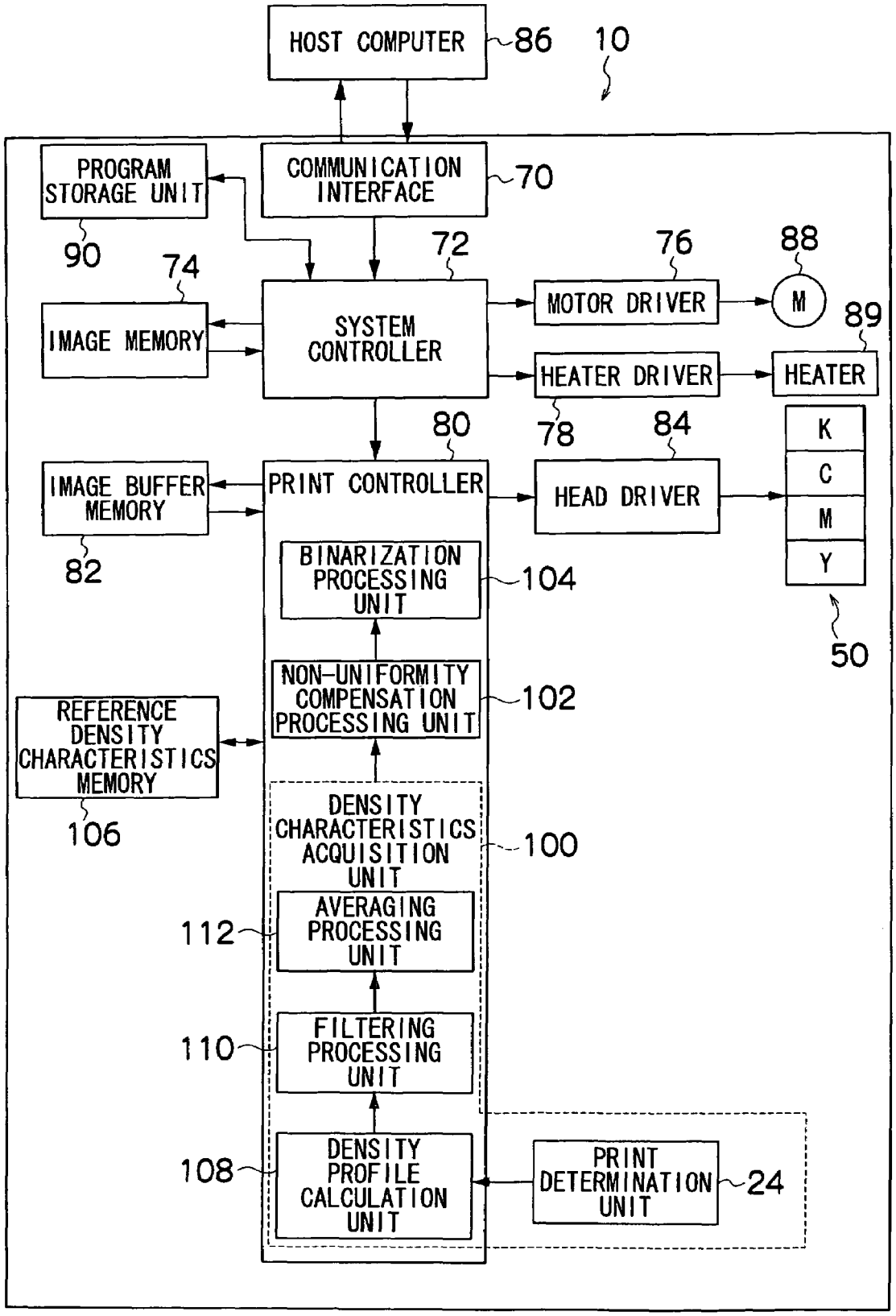
FIG. 7 is a partial block diagram showing the system composition of an inkjet recording apparatus according to the embodiment.

FIG. 7 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89. The software program executed by the system controller 72 is stored in a program storage unit 90.

The motor driver (drive circuit) 76 drives the motor 88 in accordance with commands from the system controller 72. The heater driver (drive circuit) 78 drives the heater 89 of the post-drying unit 42 (see FIG. 1) or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (print data) to the head driver 84. Required signal processing is carried out in the print controller 80, and the ejection amount and the ejection timing of the ink droplets from the respective print heads 50 are controlled via the head driver 84, on the basis of the print data.

The print controller 80 is provided with the image buffer memory 82; and image data, parameters, and other data are temporarily stored in the image buffer memory 82 when image data is processed in the print controller 80. The example shown in FIG. 7 is one in which the image buffer memory 82 accompanies the print controller 80; however, the image memory 74 may also serve as the image buffer memory 82. Also possible is an example in which the print controller 80 and the system controller 72 are integrated to form a single processor.

Moreover, the print controller 80 also comprises a density characteristics acquisition unit 100, a non-uniformity compensation processing unit 102, and a binary processing unit (quantization processing unit) 104, in order to compensate non-uniformity of density. Furthermore, the print controller 80 also comprises a reference density characteristics memory 106 which stores reference density characteristics that have been acquired previously.

The density characteristics acquisition unit 100 calculates the micro density characteristics, which are the density characteristics of the areas corresponding to the nozzles (nozzle periphery), according to landing position errors measured on the basis of a special pattern. The landing position errors are calculated on the basis of the density profile, which is read in optically from the special test pattern, for example. To achieve such purposes, the density characteristics acquisition unit 100 comprises: a sensor required for measuring the landing position errors from the special pattern (the print determination unit 24 also serves as this sensor in the present embodiment, for example); a density profile calculation unit 108 which estimates (predicts) a one-dimensional density profile of the non-uniformity of density; a filtering processing unit 110 which carries out filtering processing with respect to the one-dimensional density profile thus estimated; and an averaging processing unit 112 which calculates the micro density characteristics by performing an averaging process with respect to the density profile that has been subjected to the filtering, for each of the areas corresponding to the nozzles.

The acquisition of the density characteristics of the areas corresponding to the respective nozzles is not limited to using a calculation method of this kind.

The non-uniformity compensation processing unit 102 compensates non-uniformity of density by compensating the droplet ejection rate signal in such a manner that the calculated micro density characteristics coincide with the reference density characteristics. Furthermore, the binary processing unit 104 binarizes the compensated droplet ejection signal, by means of a half-toning process of an error diffusion method.

In a normal printing operation, the print controller 80 compensates non-uniformity of density in the input image signal in this way, and the compensated output image signal is then output to the head driver 84. Below, the detailed actions of the respective units will be explained by describing the method for compensating non-uniformity of density.

Figure 8:
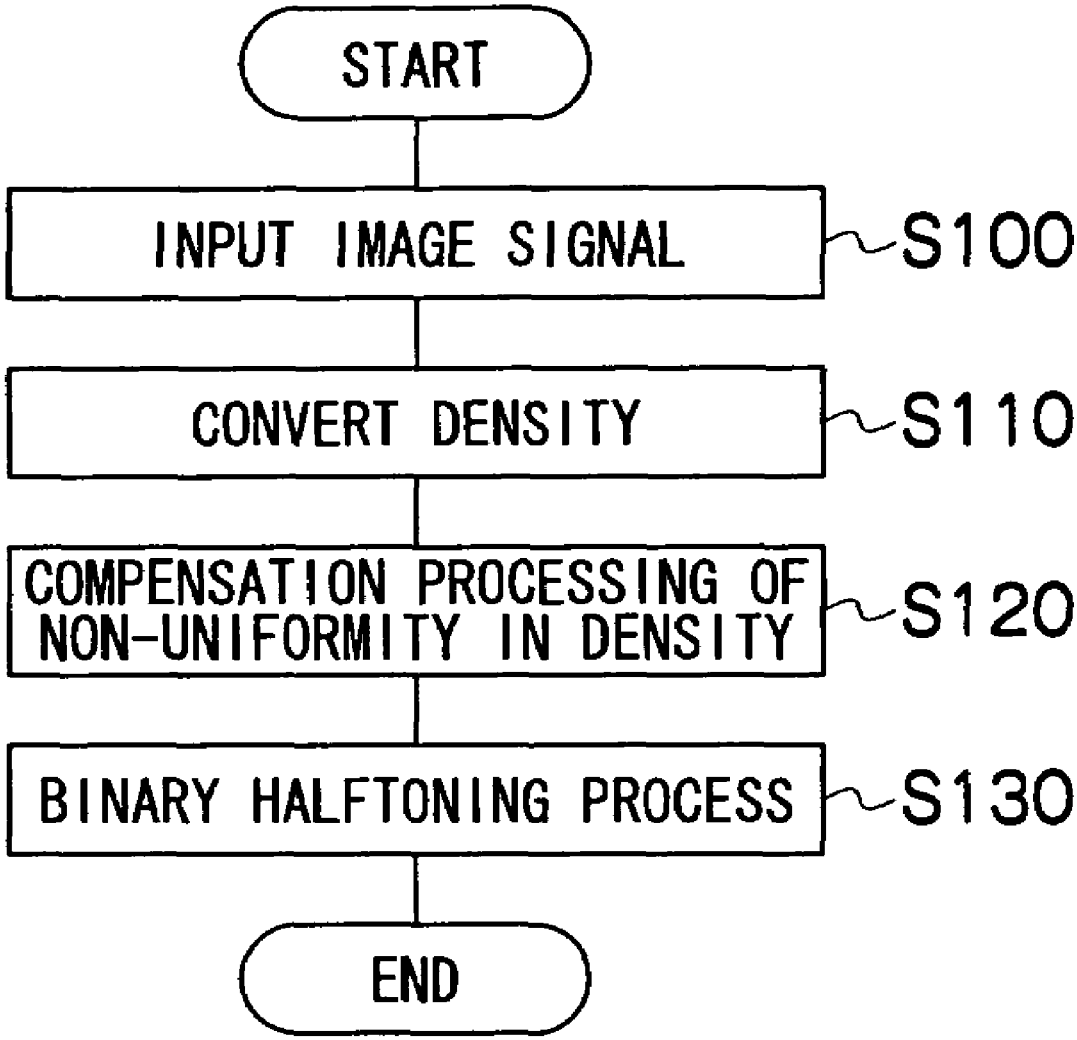
FIG. 8 is a flowchart showing the sequence of image processing including non-uniformity of density compensation processing according to the embodiment.

FIG. 8 is a flowchart showing the sequence of image processing including the compensation processing of non-uniformity of density in the present embodiment.

Firstly, at step S100 in FIG. 8, an image signal containing density graduation information is input to the inkjet recording apparatus 10. The image signal is input to the image memory 74 from the host computer 86, via the communications interface 70.

Next, at step S110, the print controller 80 receives the input image signal from the image memory 74 via the system controller 72, and performs a density conversion (inverse conversion of the reference density characteristic), and thereby a control signal for C (cyan), M (magenta), and Y (yellow) (, K (black), LC (light cyan), and LM (light magenta)) containing droplet ejection rate information of 0% to 100% is obtained.

In this case, UCR (under color removal) processing, and distribution processing to light inks, such as LC and LM, are also carried out simultaneously.

The reference density characteristics Dreff(P) are, for example, measured before shipment of the apparatus, arranged in the form of a table, and stored previously in the reference density characteristics memory 106.

Figure 9:
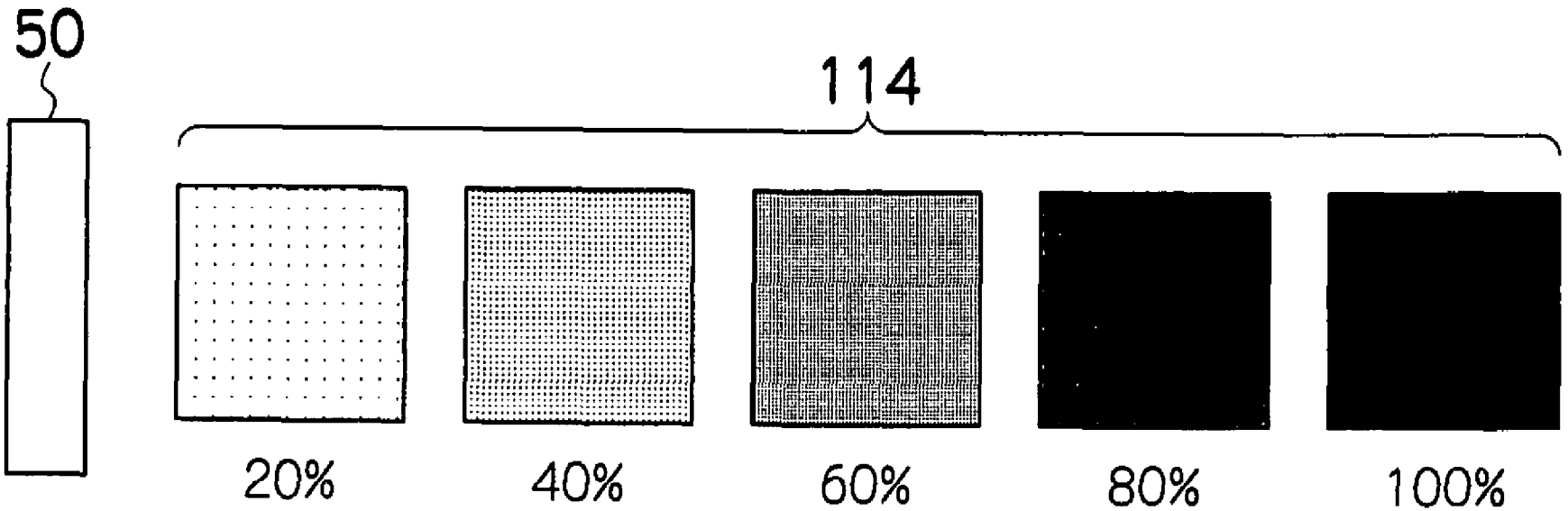
FIG. 9 is an illustrative diagram showing a chart for measuring reference density characteristics.

The reference density characteristics Dreff(P) are measured in the following way, for example. More specifically, firstly, as shown in FIG. 9, a chart (solid image) 114 is created by varying the droplet ejection rate P of the print head 50 in the range from 20% to 100%, in steps of 20%, for example.

In this case, as a method which the reference density characteristics are obtained according to, instead of the method which involves measuring the macro density and setting a reference value in the above-described way, the reference density characteristics may also be acquired by taking the average value of the micro density characteristics as the reference value. Alternatively, from among the micro density characteristics, the micro density characteristics value showing the smallest droplet ejection errors in the nozzle in question and the peripheral nozzles thereof may be calculated, and this value of the micro density characteristics may be set as the reference value.

Figure 10:
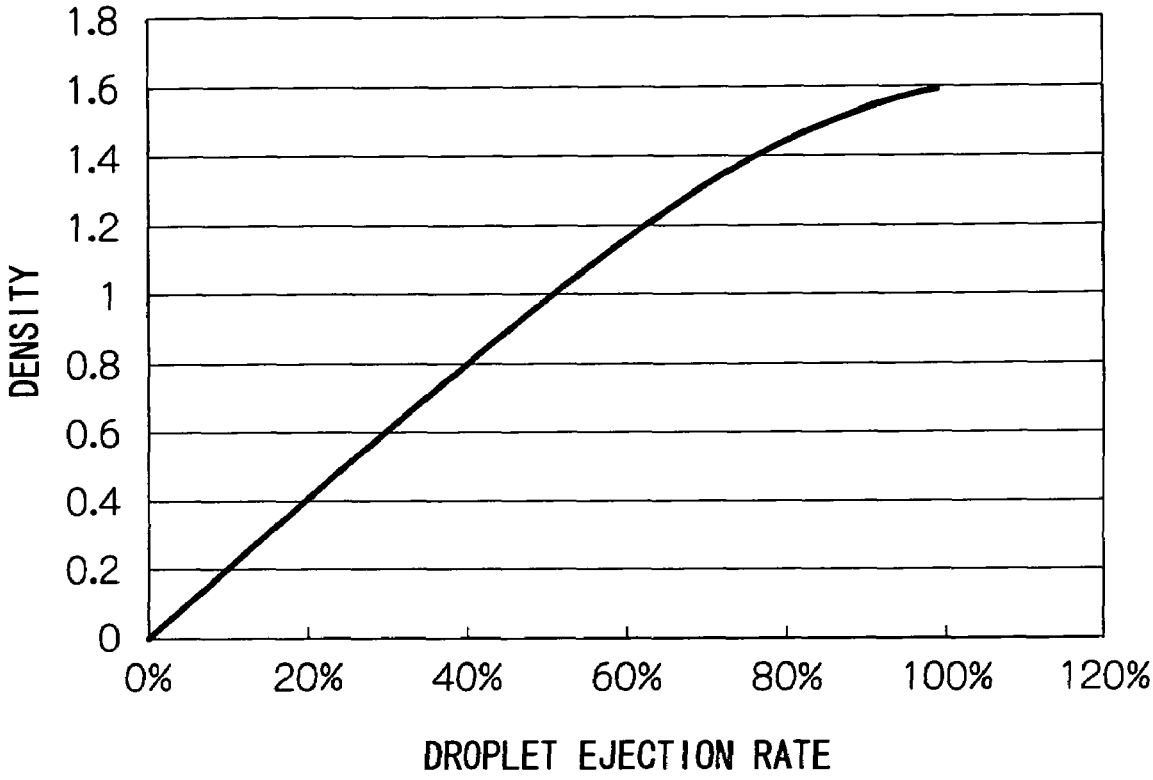
FIG. 10 is a graph showing an example of reference density characteristics.

Next, the optical density of each portion of the chart 114 is measured by the optical sensor of the print determination unit 24, and reference density characteristics Dreff(P) which indicate a relationship between the droplet ejection rate and the optical density are obtained, as shown in FIG. 10. By previously storing a table of the reference density characteristics such as that shown in FIG. 10, the droplet ejection rate can be determined by carrying out the calculation with reference to this table if density graduation information is received as an input signal and it is required to obtain a certain density.

Next, at step S120, the non-uniformity compensation processing unit 102 carries out the compensation processing of non-uniformity of density, with respect to the C/M/Y control signal containing the droplet ejection rate information.

Figure 11:
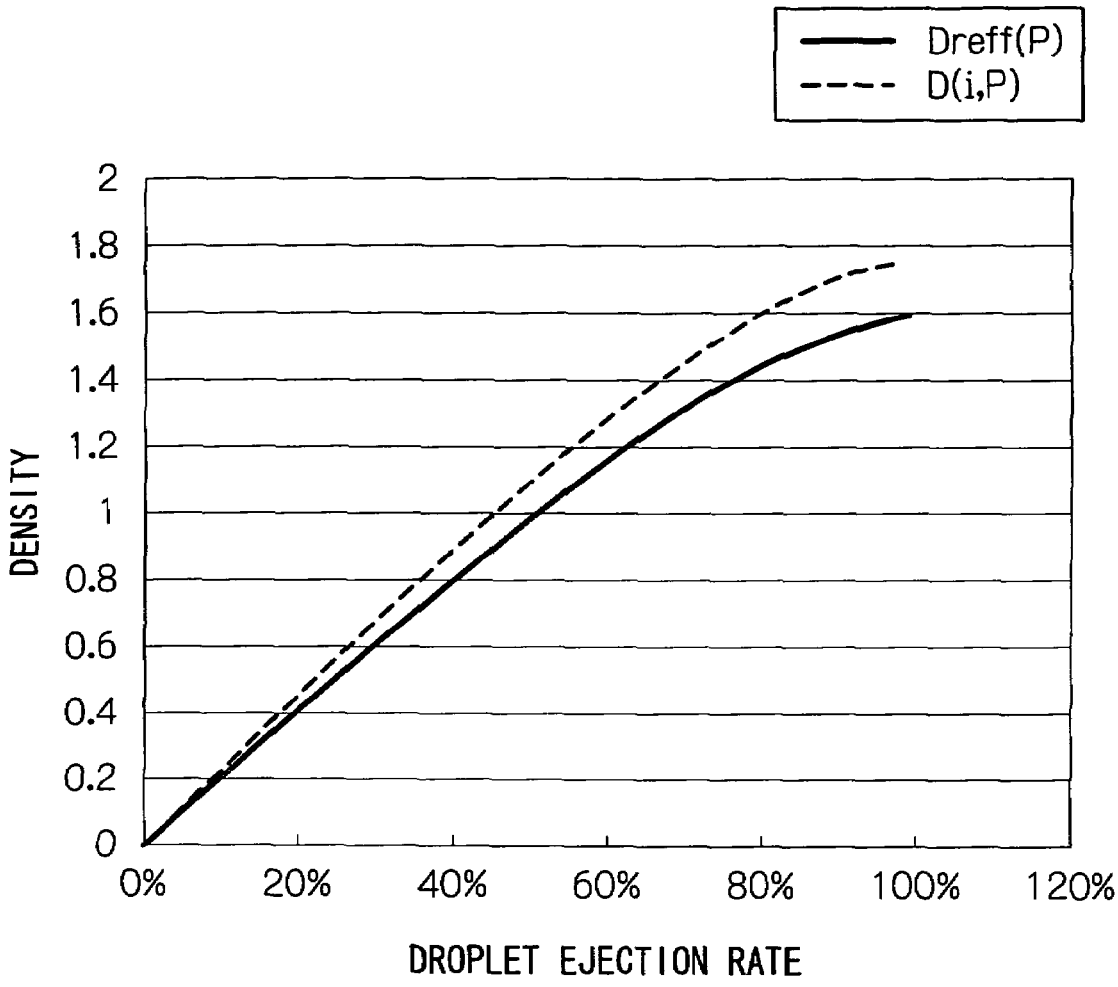
FIG. 11 is a graph showing the differential between micro density characteristics and reference density characteristics.

For example, as shown in FIG. 11, the density characteristics (micro density characteristics) D(i,P) of the area corresponding to the nozzle (nozzle periphery) (where i indicates the nozzle number and P indicates the droplet ejection rate) have errors (displacement) with respect to the reference density characteristics Dreff(P). The droplet ejection rate signal is compensated in such a manner that the micro density characteristics D(i,P) coincide with the reference density characteristics Dreff(P).

Next, at step S130, halftoning based on the error diffusion method, or the like, is carried out with respect to the droplet ejection rate signal (C/M/Y/K (LC/LM) control signal) which has been subjected to the compensation processing of non-uniformity of density in this way, and thereby the droplet ejection rate signal is binarized.

Figure 12:
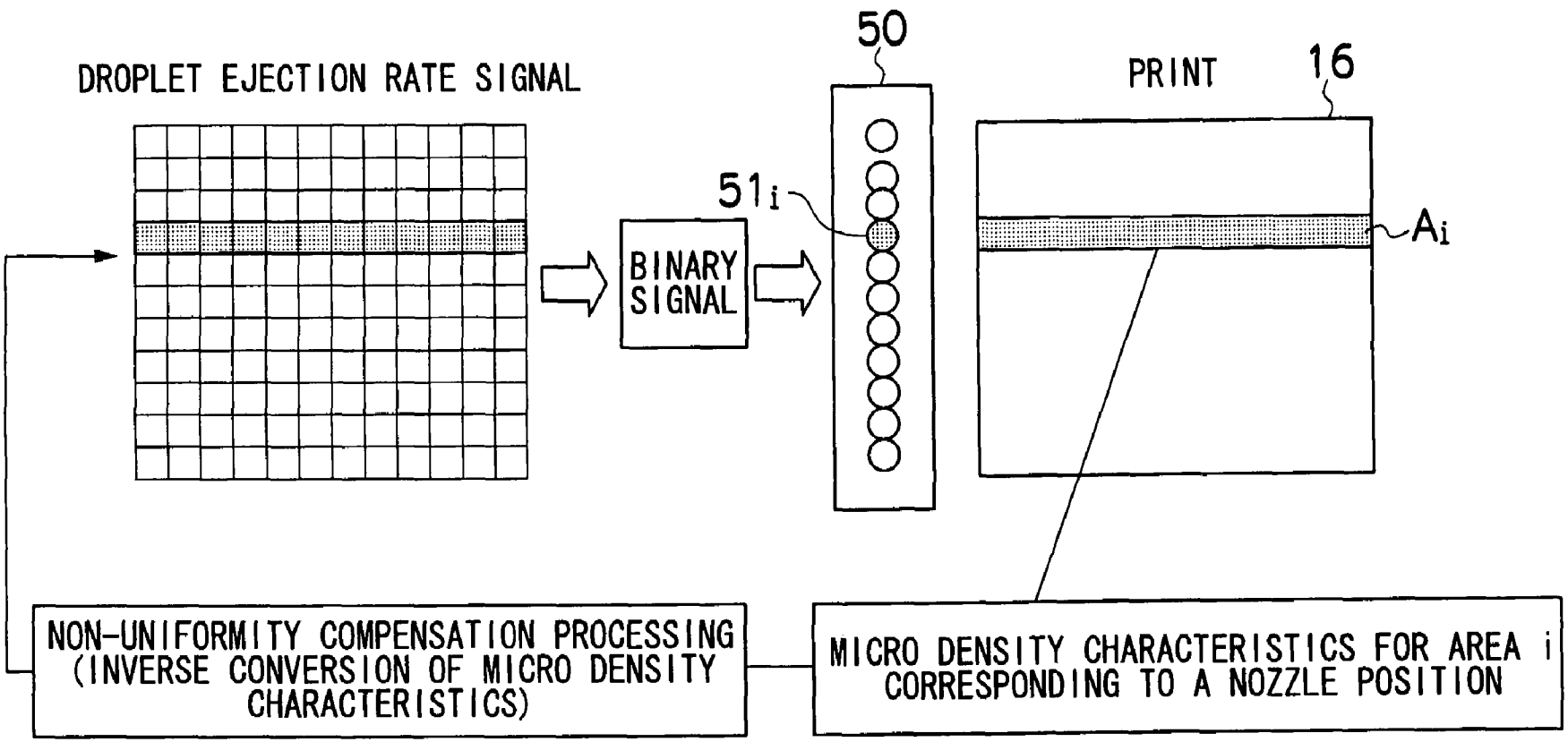
FIG. 12 is a conceptual diagram showing non-uniformity of density compensation processing.

FIG. 12 shows a conceptual diagram of the compensation processing of the non-uniformity of density described above. The micro density characteristics D(i,P) of the print area Ai corresponding to the i-th nozzle $\mathbf{51}_i$ of the print head 50 are acquired, a droplet ejection rate signal is obtained by performing the inverse conversion of the micro density characteristics, non-uniformity compensation processing and halftoning processing are then carried out on this droplet ejection rate signal, and thereby a binary signal is obtained. By recording an image by ejecting droplets to form dots from the print head 50 on the basis of this binarized signal, it is possible to obtain an image in which non-uniformity of density has been compensated.

Next, the method of acquiring the micro density characteristics used in the non-uniformity compensation processing will be described.

Since the landing position error characteristics vary between the heads of different colors, the micro density characteristics are acquired with respect to each color, namely, C, M, Y, (and K, LC and LM).

Figure 13:
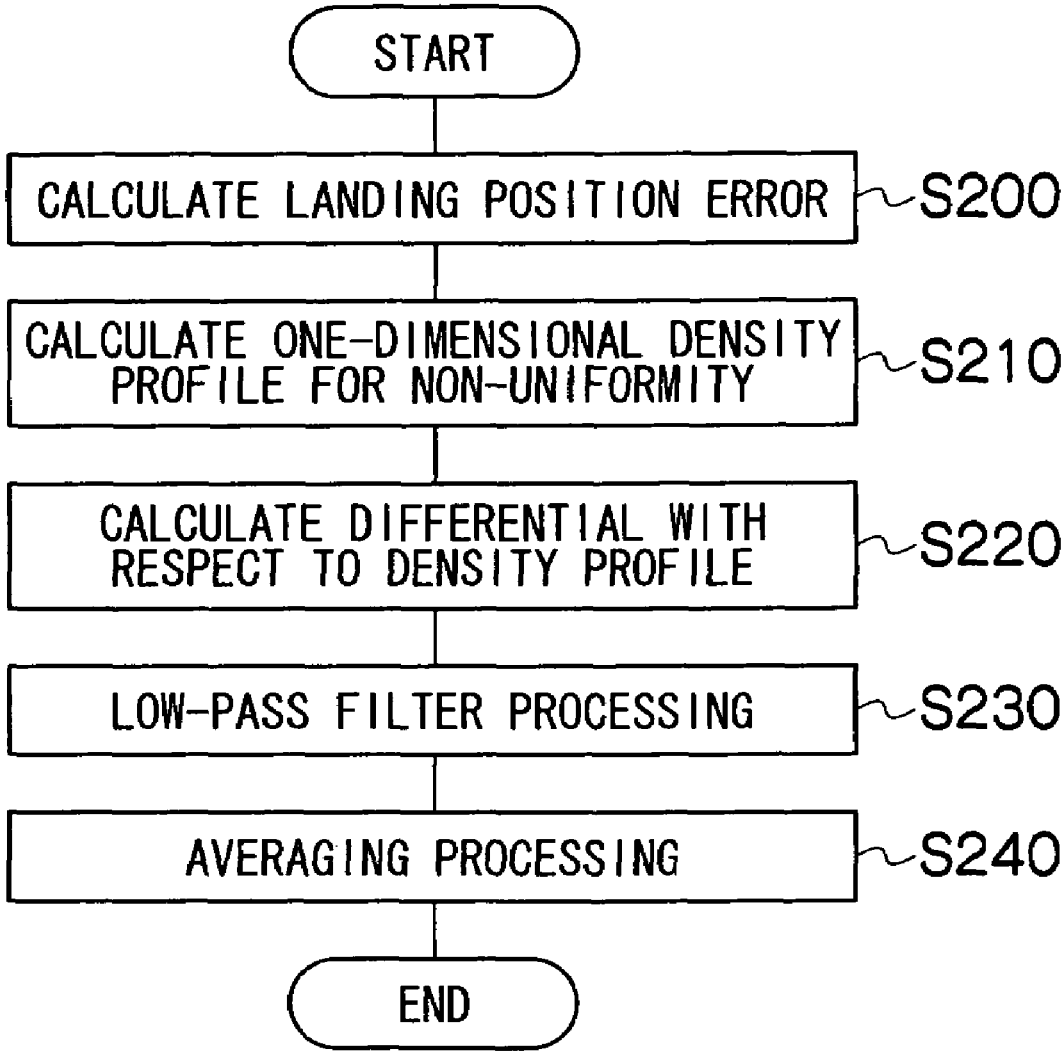
FIG. 13 is a flowchart showing a method of acquiring micro density characteristics.

FIG. 13 is a flowchart showing a method of acquiring micro density characteristics. The description below follows this flowchart.

Figure 14:
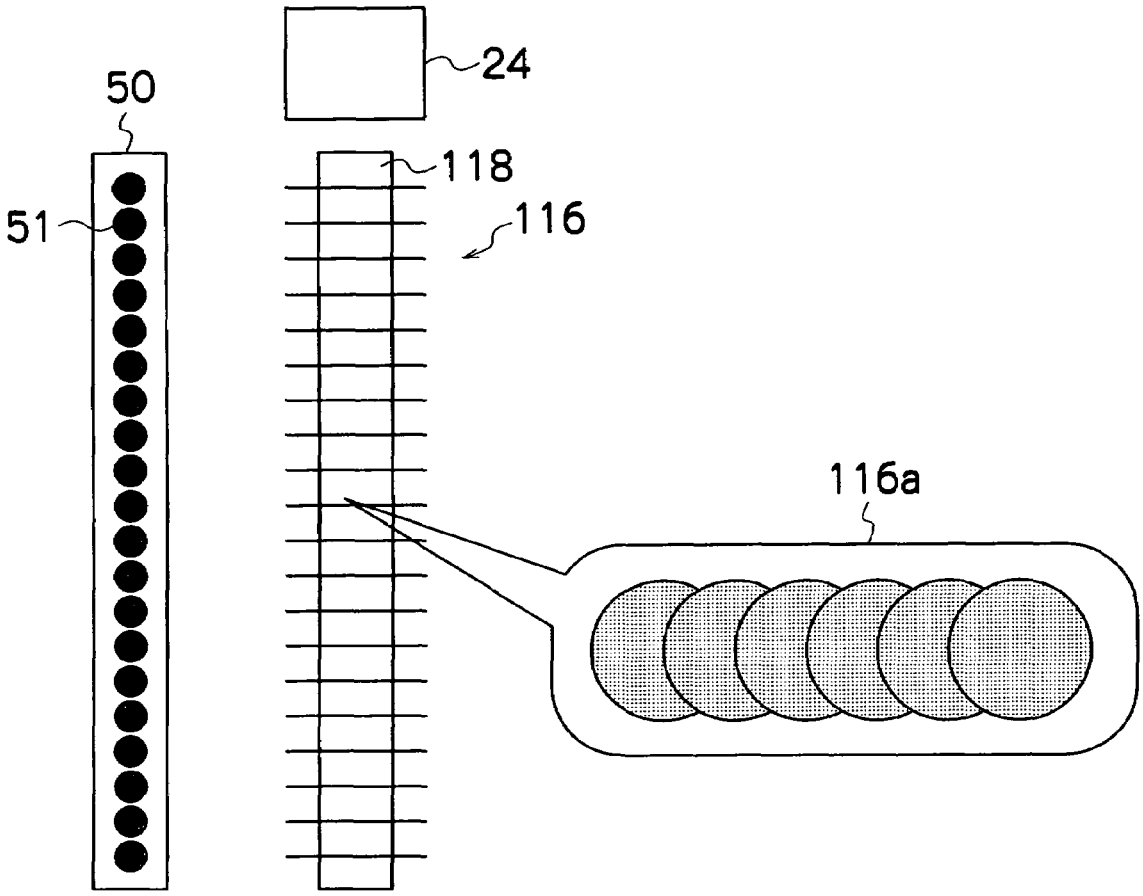
FIG. 14 is an illustrative diagram showing a method of measuring landing position errors.

Firstly, at step S200 in FIG. 13, the errors in the landing positions of the nozzles are measured. For this purpose, droplets are ejected to form dots from the respective nozzles 51 of the print head 50, and thereby a special test pattern 116 is created as shown in FIG. 14. Each line of the test pattern 116 is formed by the dots of the ink droplets ejected from one nozzle 51, as shown by the partial enlargement indicated by the reference numeral 116*a*.

Figure 15:
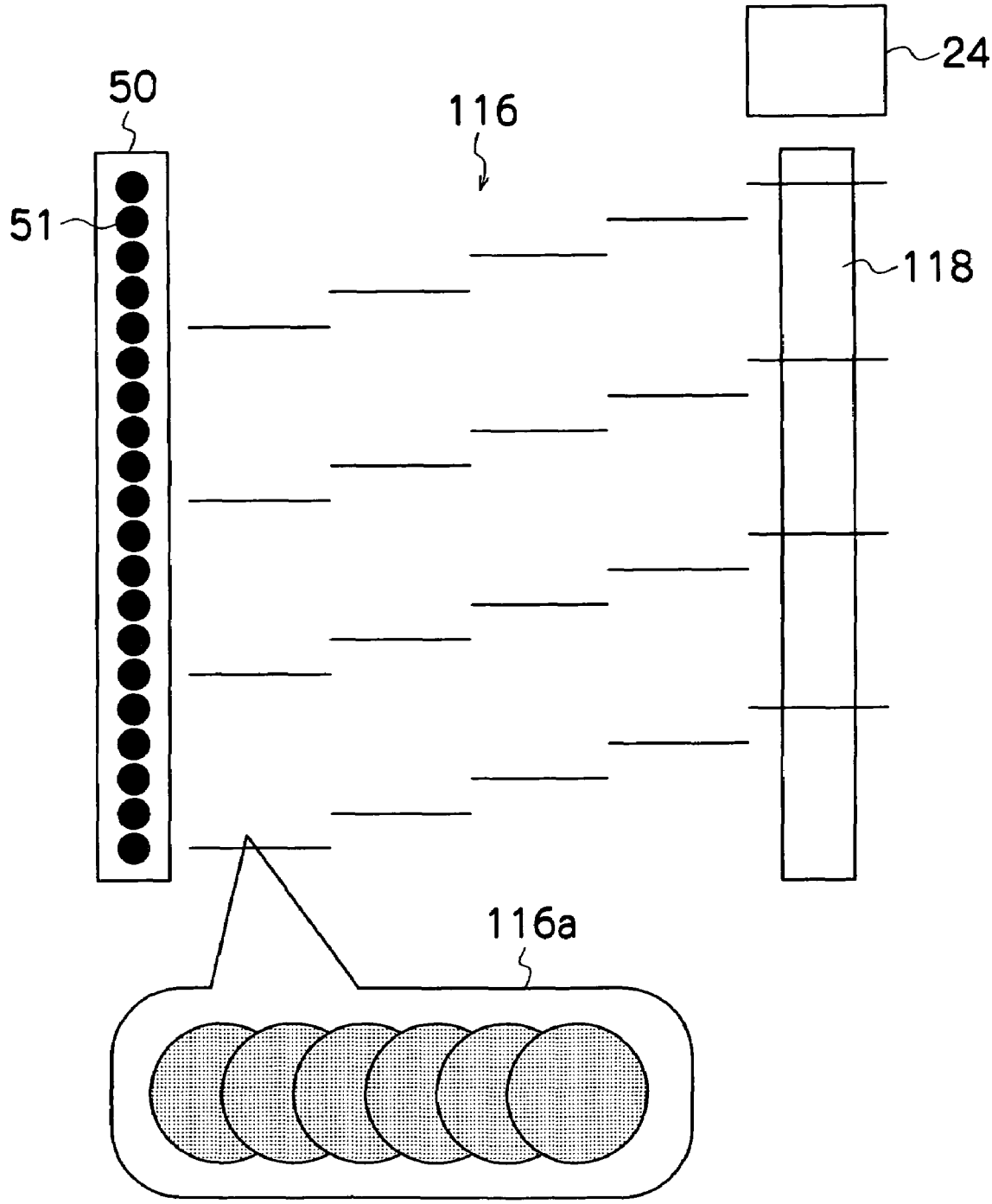
FIG. 15 is also an illustrative diagram showing a method of measuring landing position errors.

Furthermore, in this case, in order to prevent mutually adjacent lines from touching each other, it is possible to adopt a step-like pattern, as shown in FIG. 15.

The density profile of this test pattern 116 is read in optically, for example, by the optical sensor of the print determination unit 24. The print determination unit 24 reads in the test pattern in such a manner that the read-in-region 118 is substantially perpendicular to the lines of the test pattern 116. This reading process may be carried out a plurality of times, for each step.

Figure 16:
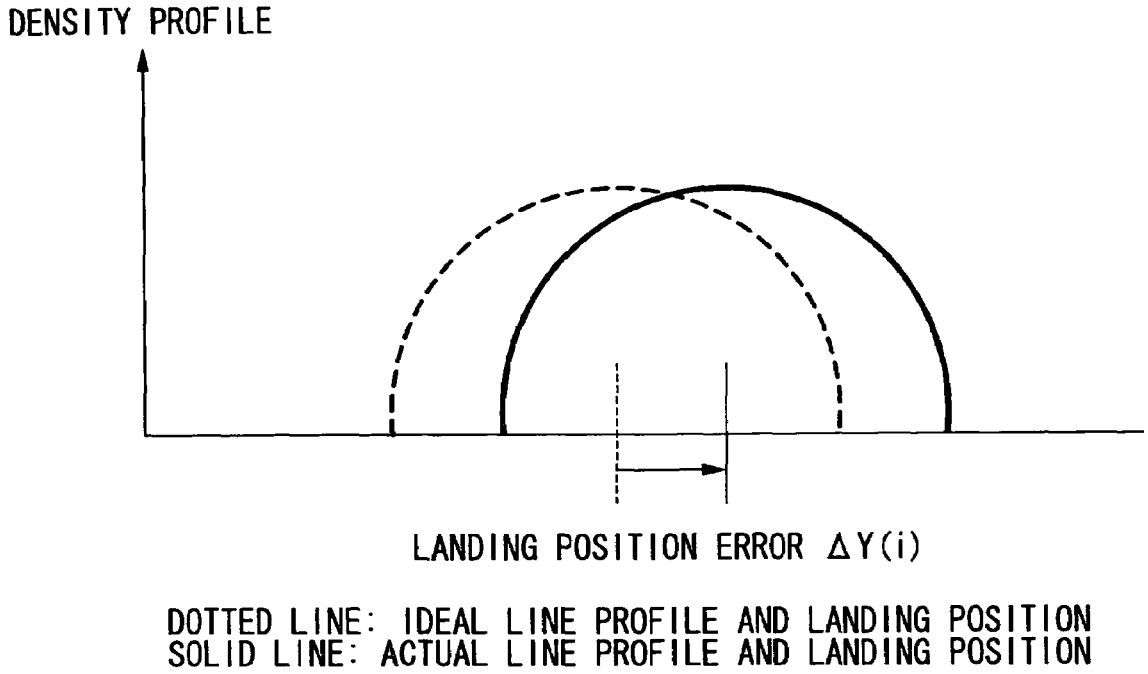
FIG. 16 is an illustrative diagram showing a density profile which represents landing positions.

The displacement from the ideal landing position (landing position error ΔY(i)) is calculated for each nozzle 51 (nozzle number i) on the basis of the density profile thus read in. FIG. 16 shows a density profile indicating the respective landing positions. The solid line in FIG. 16 indicates the density profile (landing positions) that is read in, and the broken line indicates an ideal density profile (landing positions). Each of the density profiles show a semicircular shape, and the distance between the center points of these profiles is taken to be the landing position error ΔY(i).

In the following description, the nozzle resolution is taken to be 400 nozzles per inch (npi) (i.e., the nozzle pitch is 63.5 μm), the dot diameter is taken to be 30 μm, and the landing position error of a nozzle having nozzle number i, or ΔY(i), is taken to be 10 μm.

If there are significant levels of errors in the line width and line-density due to errors in the ejection volume, then the errors in the ejection volumes of the nozzles are significant as the causes of non-uniformity of density. In cases of this kind, it is also possible to measure the error characteristics of the ejection volume, in addition to the landing position errors.

Next, at step S210, the one-dimensional density profile of non-uniformity is calculated. The density profile in step S200 is a density profile of a special test pattern, and it is different from the one-dimensional density profile of non-uniformity in step S210.

Figure 17:
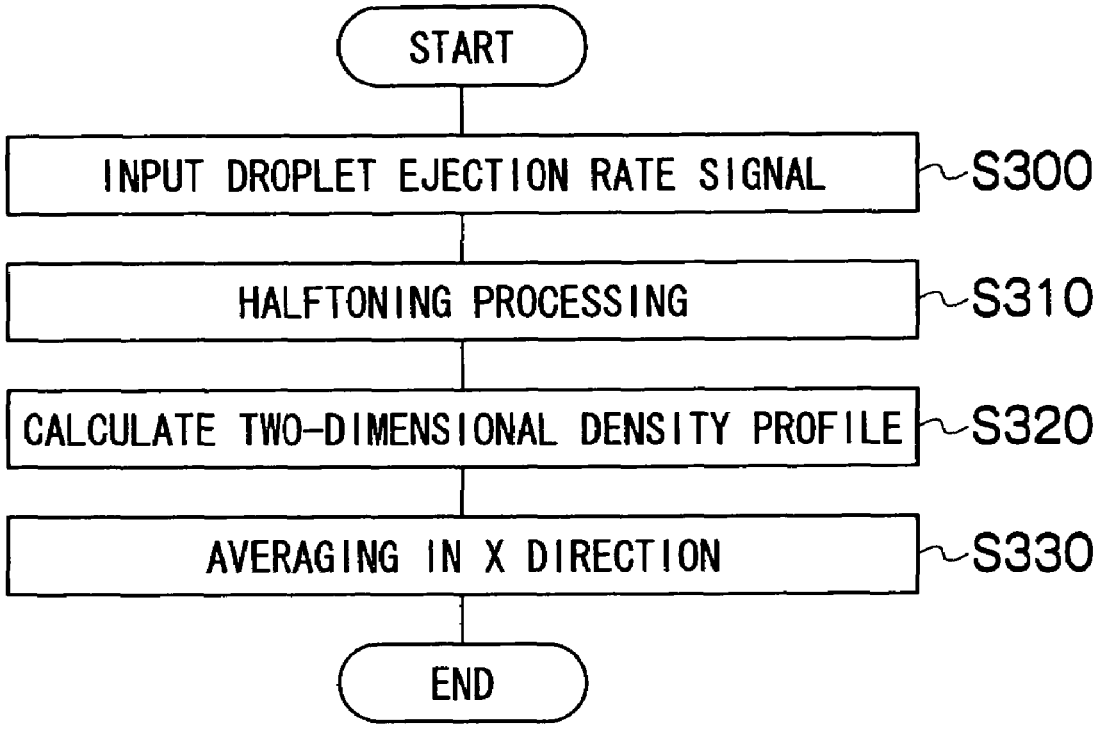
FIG. 17 is a flowchart showing a procedure for calculating a one-dimensional density profile for non-uniformity.

FIG. 17 is a flowchart showing procedures for estimating the one-dimensional density profile of non-uniformity. The process of estimating the one-dimensional density profile for the non-uniformity will be described on the basis of this flowchart.

Firstly, at step S300 in FIG. 17, uniform droplet ejection rate signals are input. Next, at step S310, binarized image data is obtained by means of the halftoning process.

Figure 18:
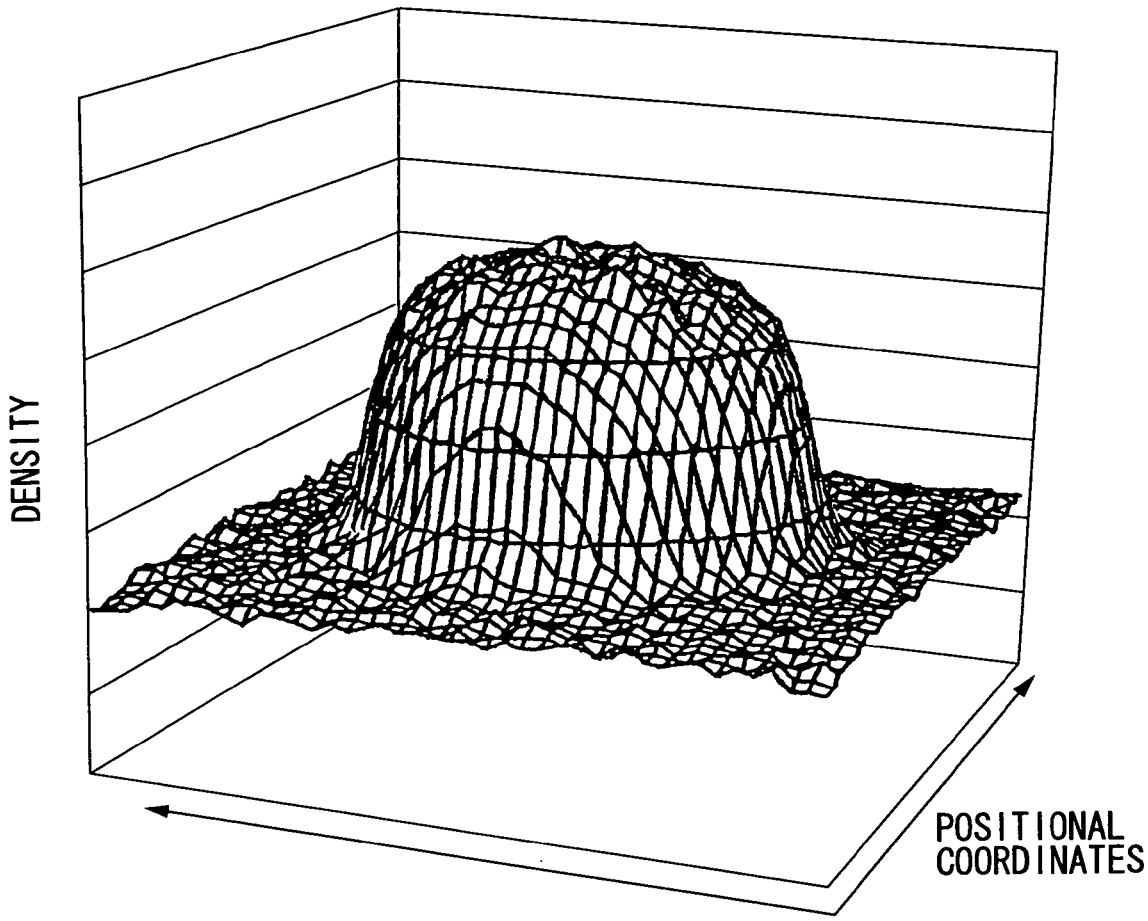
FIG. 18 is an illustrative diagram showing an example of a dot model.

Thereupon, at step S320, a two-dimensional density profile in the form of D(X,Y,P) is determined for this binary image information, on the basis of the dot model as shown in FIG. 18 and the landing position errors calculated above. The dot model as shown in FIG. 18 is a schematic model of one density profile, and it gives a three-dimensional representation of the density profile Ddot(x,y) corresponding to the positional coordinates (x,y). A dot model of this kind may be measured and stored before the shipment of the apparatus, for example.

Figure 19:
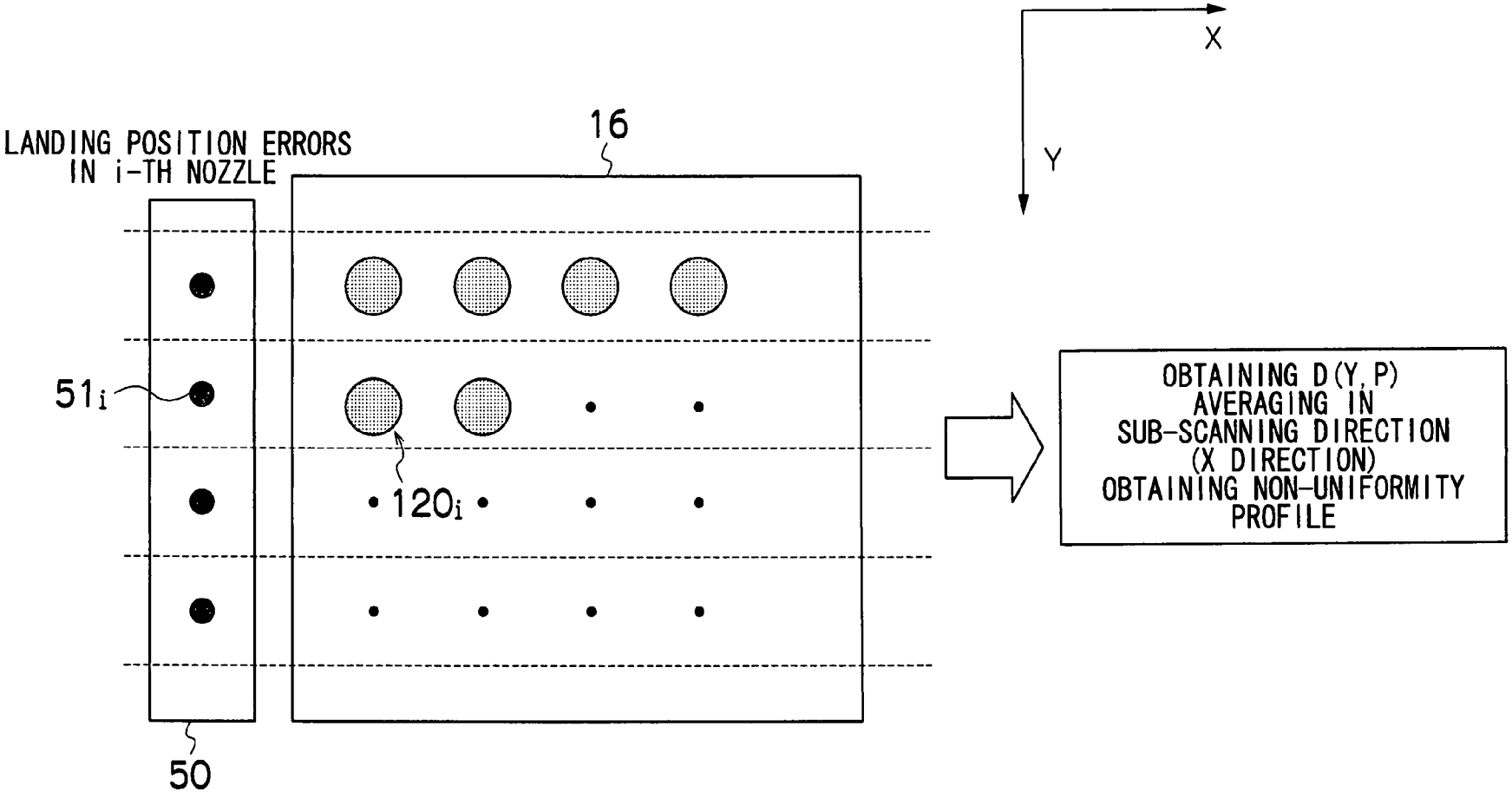
FIG. 19 is an illustrative diagram showing a method of calculating a one-dimensional density profile from a two-dimensional density profile.

In FIG. 19, for example, it is supposed that the i-th nozzle $\mathbf{51}_i$ of the print head 50 has the landing position error. In other words, as shown in FIG. 19, the dot $\mathbf{120}_i$ formed by ejecting a droplet from the i-th nozzle $\mathbf{51}_i$ is displaced slightly in the downward direction, within the print area corresponding to the nozzle $\mathbf{51}_i$. In this case, with respect to the dot $\mathbf{120}_i$, a model density profile such as that in FIG. 18 is added to the actual landing position under the influence of the landing position error, and a two-dimensional density profile D(X,Y,P) for the output image is calculated.

Next, at step S330, the two-dimensional density profile D(X,Y,P) is averaged in the X direction (sub-scanning direction) in FIG. 19, and thereby a one-dimensional density profile D(Y,P) of the non-uniformity is calculated.

Figure 20:
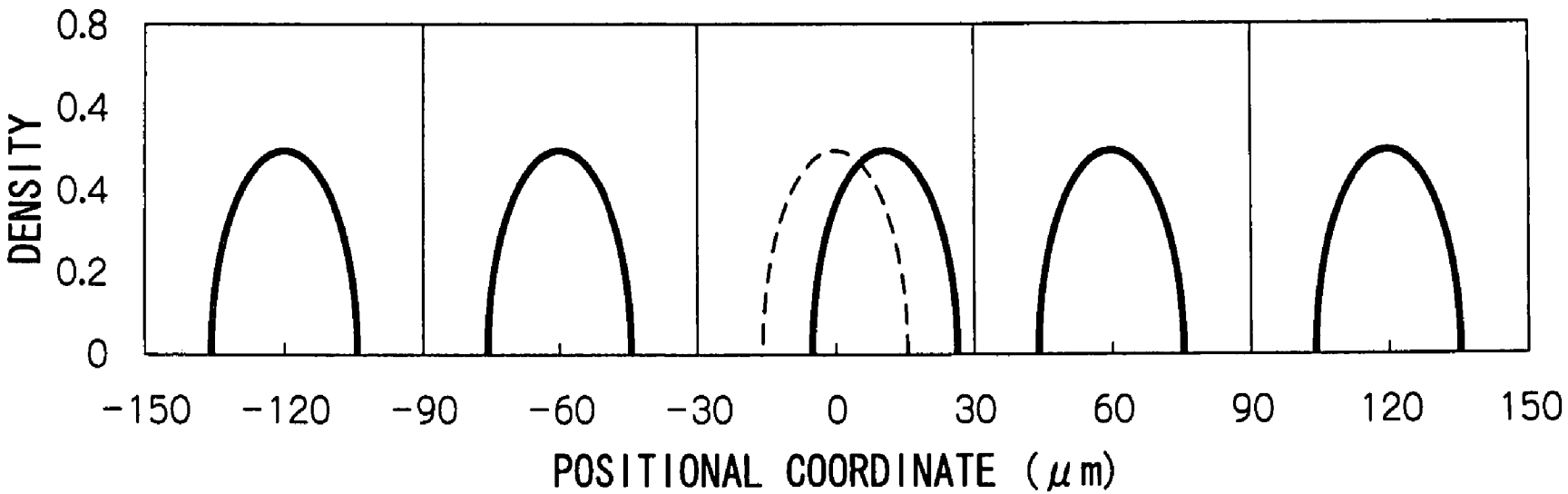
FIG. 20 is a graph showing an example of a one-dimensional density profile.

FIG. 20 shows the one-dimensional density profile D(Y,P) thus obtained. In FIG. 20, the area having a central positional coordinate of 0 (Y=0) and demarcated by the vertical lines is taken to be the area corresponding to the i-th nozzle $\mathbf{51}_i$.

In FIG. 20, the solid lines indicate the one-dimensional density profile that is determined above, and the dotted line indicates an ideal density profile in which there is no landing position error. In the example shown in FIG. 20, it is supposed that the i-th nozzle $\mathbf{51}_i$ has the landing position error in the positive direction (the rightward direction in FIG. 20).

Furthermore, the density profile is made to have the resolution that is at least twice as high as the nozzle resolution. The resolution of the density profile is preferably an integer (at least two) times as high as the nozzle resolution, or a real number (at least two) times as high as the nozzle resolution.

Furthermore, depending on the characteristics of the media (recording paper 16), a case in which the density-increase-characteristics in the overlapping regions of dots are not linear may arise. In such a case, it is possible to use a non-linear addition method in adding the dot model.

Figure 21:
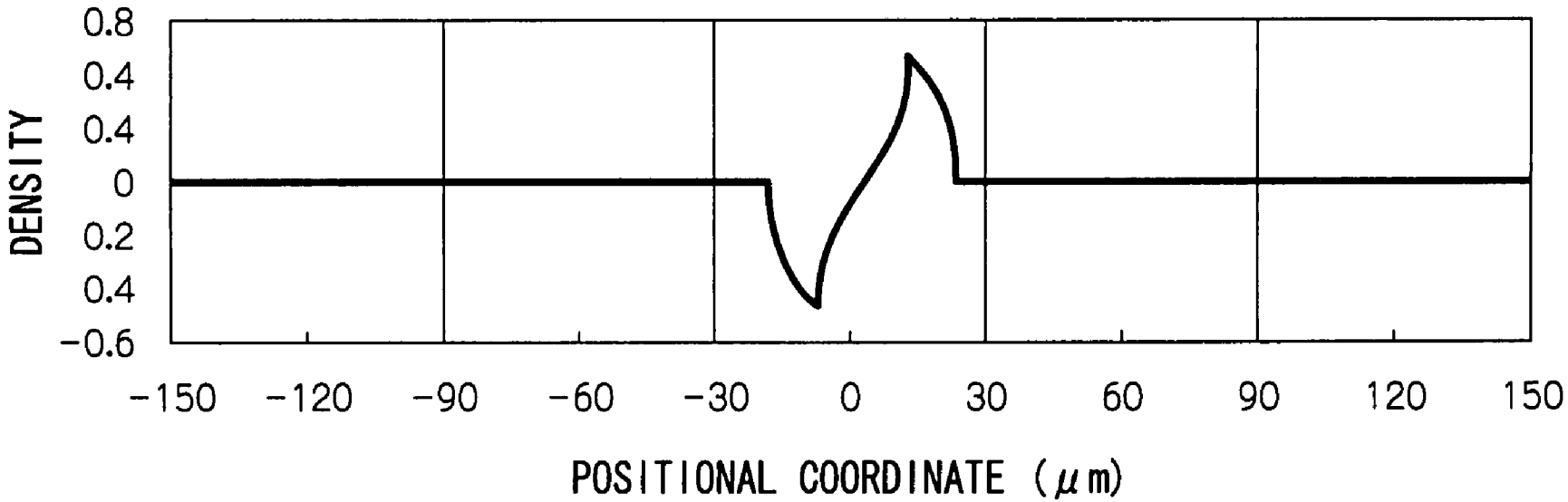
FIG. 21 is a graph showing the differential of a density profile.

Returning to the flowchart in FIG. 13, at step S220, the differential between the obtained density profile and the ideal density profile is derived. FIG. 21 shows the results of deriving the differentials. These differentials are factors of the visible non-uniformity of density.

Next, at step S230, the density profile thus obtained is subjected to a low-pass filtering process. More specifically, firstly, a Fourier transform is carried out, followed by the low-pass filtering process, and then an inverse Fourier transform is carried out. The cut-off frequency of the filter used here is set to be equal to the nozzle resolution or the reciprocal of the nozzle pitch, in such a manner that high-frequency components not lower than the nozzle resolution are removed.

In this case, the density profile is subjected to the Fourier transform, and then passed through the low-pass filter. The reflective density (optical density) D is a logarithmic value of the optical reflectivity $R=10^{-D}$. Hence, in a precise sense, it is more appropriate to carry out the calculations of the spatial processing including the averaging and the Fourier transform, in the exponential range.

Figure 22:
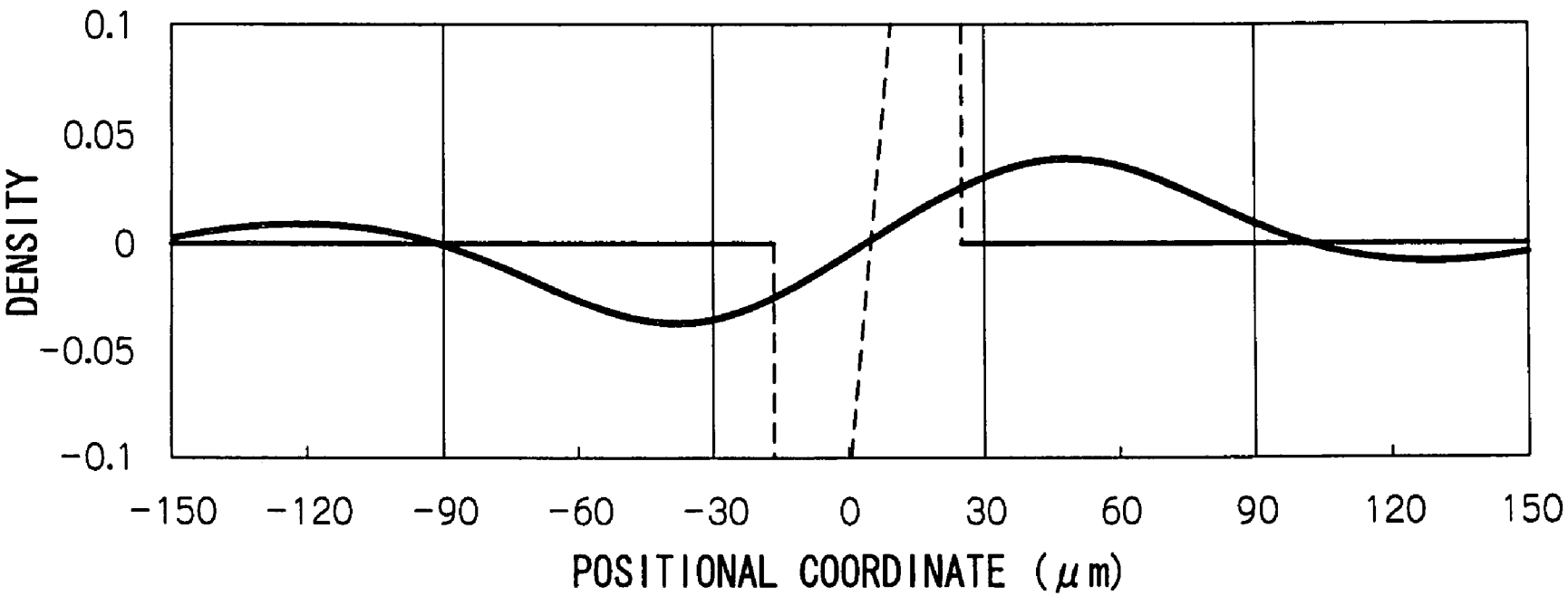
FIG. 22 is a graph showing a density profile after low-pass filtering with respect to the differential.

FIG. 22 shows the density profile obtained in this way. As shown in FIG. 22, the dots printed by the i-th nozzle $\mathbf{51}_i$ in the print area indicated by the positional coordinate 0 do not project into the adjacent print areas; however, when the low-frequency component of the density profile is observed, it can be seen that they have effect on both of the adjacent print areas (the print areas having positional coordinates of ±60 μm).

Figure 23:
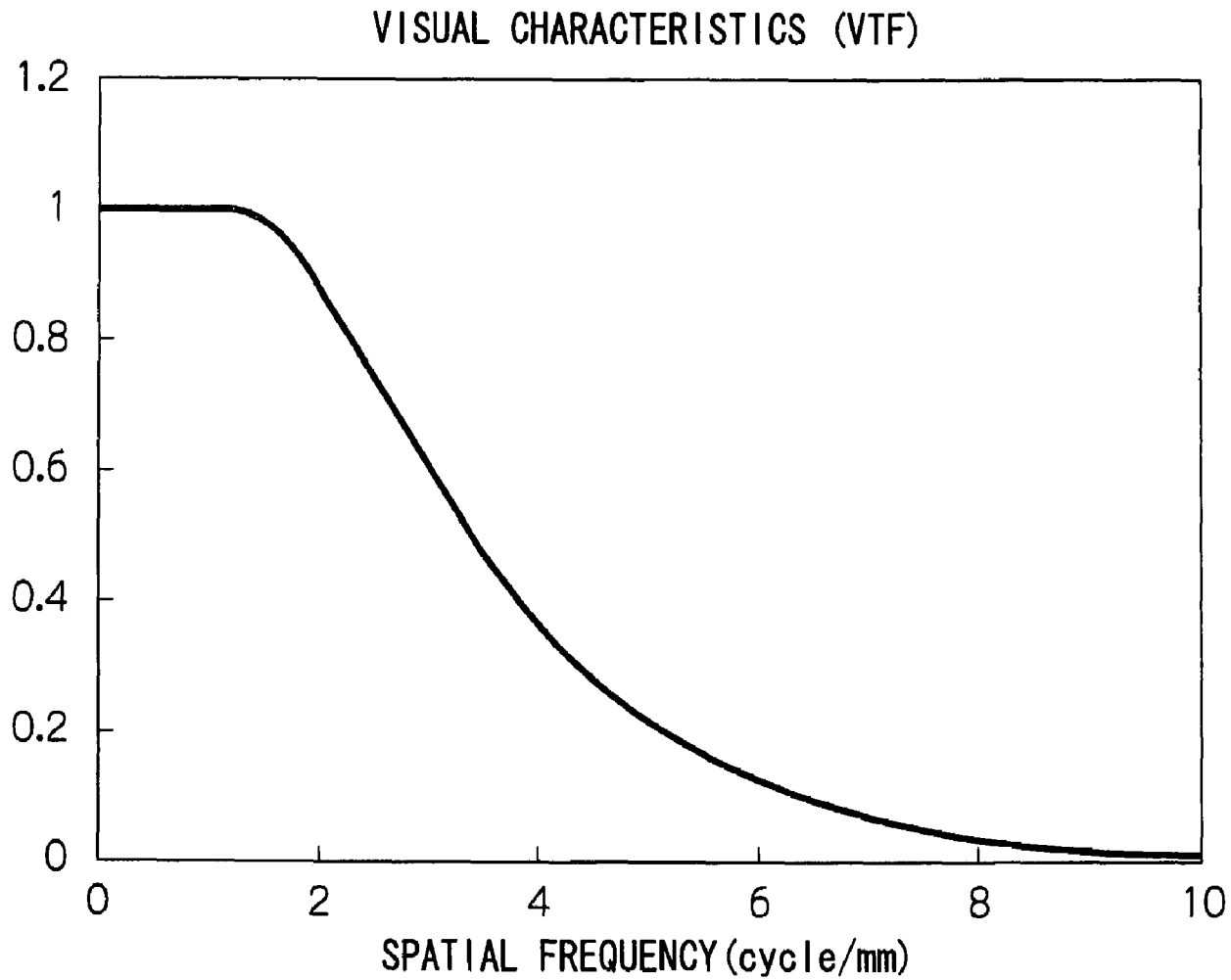
FIG. 23 is a graph showing human visual characteristics (VTF: Visual Transfer Function)

Human visual characteristics (VTF: Visual Transfer Function) have the low-pass type of characteristics as shown in FIG. 23. Accordingly, in this case, it turns out that it is preferable that the low-frequency components are considered, in order to compensate non-uniformity of density suitably. By performing the low-pass filtering process in this way after acquiring a profile with high-resolution, it is possible to suitably deal with the influence on the surrounding print areas. If the nozzle resolution is 400 npi or above, then the high-frequency components not lower than the nozzle resolution are not visible to the naked eye, and therefore, no adverse effect would arise even if these parts are excluded.

Thereupon at step S240, the density profile calculated above is subjected to the averaging process in units of the print areas corresponding to respective nozzle positions, and thereby the micro density characteristics (density characteristics of the areas corresponding to the nozzles), D(i,P), are calculated. Here, i indicates the nozzle number and P indicates the droplet ejection rate.

Figure 24:
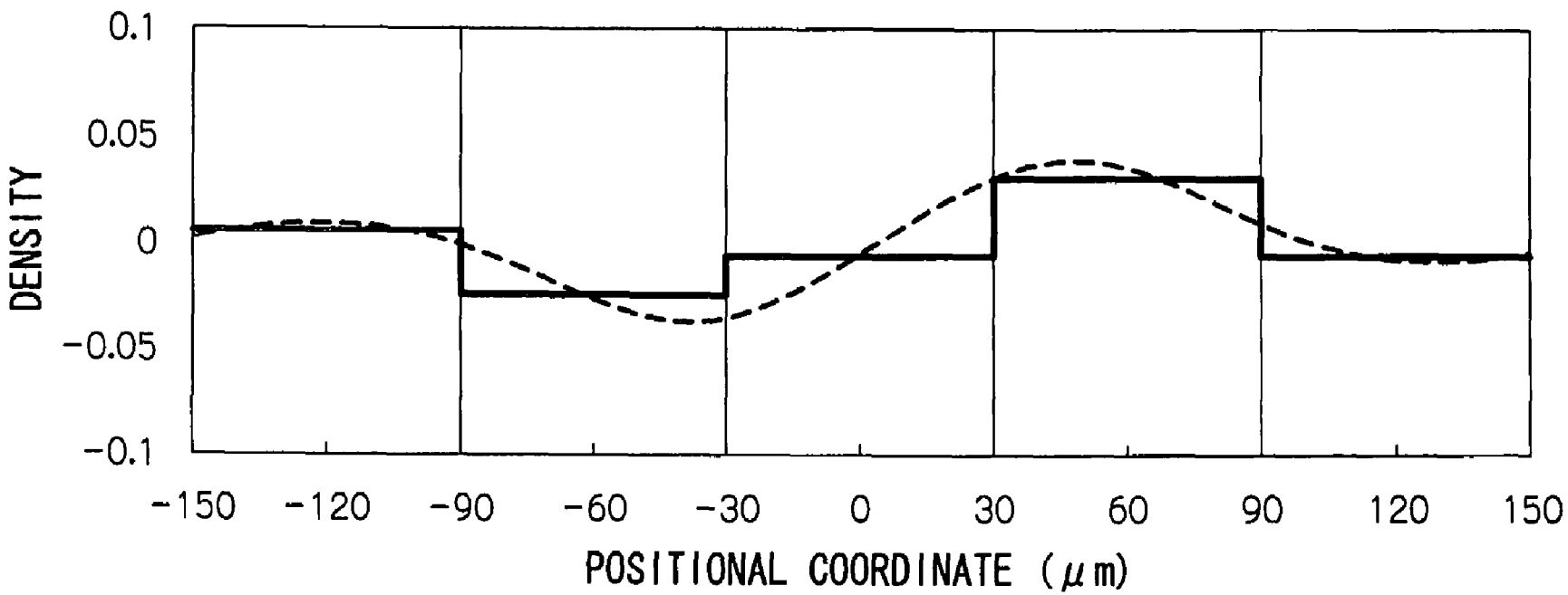
FIG. 24 is a graph showing micro density characteristics obtained by an averaging process.

FIG. 24 shows the micro density characteristics obtained by carrying out the averaging process in units of the print areas. The micro density characteristics are represented by a step-shaped graph which has a uniform density value for each print area, as shown in FIG. 24.

In the present embodiment, in this way, non-uniformity of density can be compensated by obtaining the density characteristics (micro density characteristics) of the print areas corresponding to the nozzles and compensating the signal in such a manner that the density characteristics of the print areas respectively match the reference density characteristics stored previously.

Figure 25:
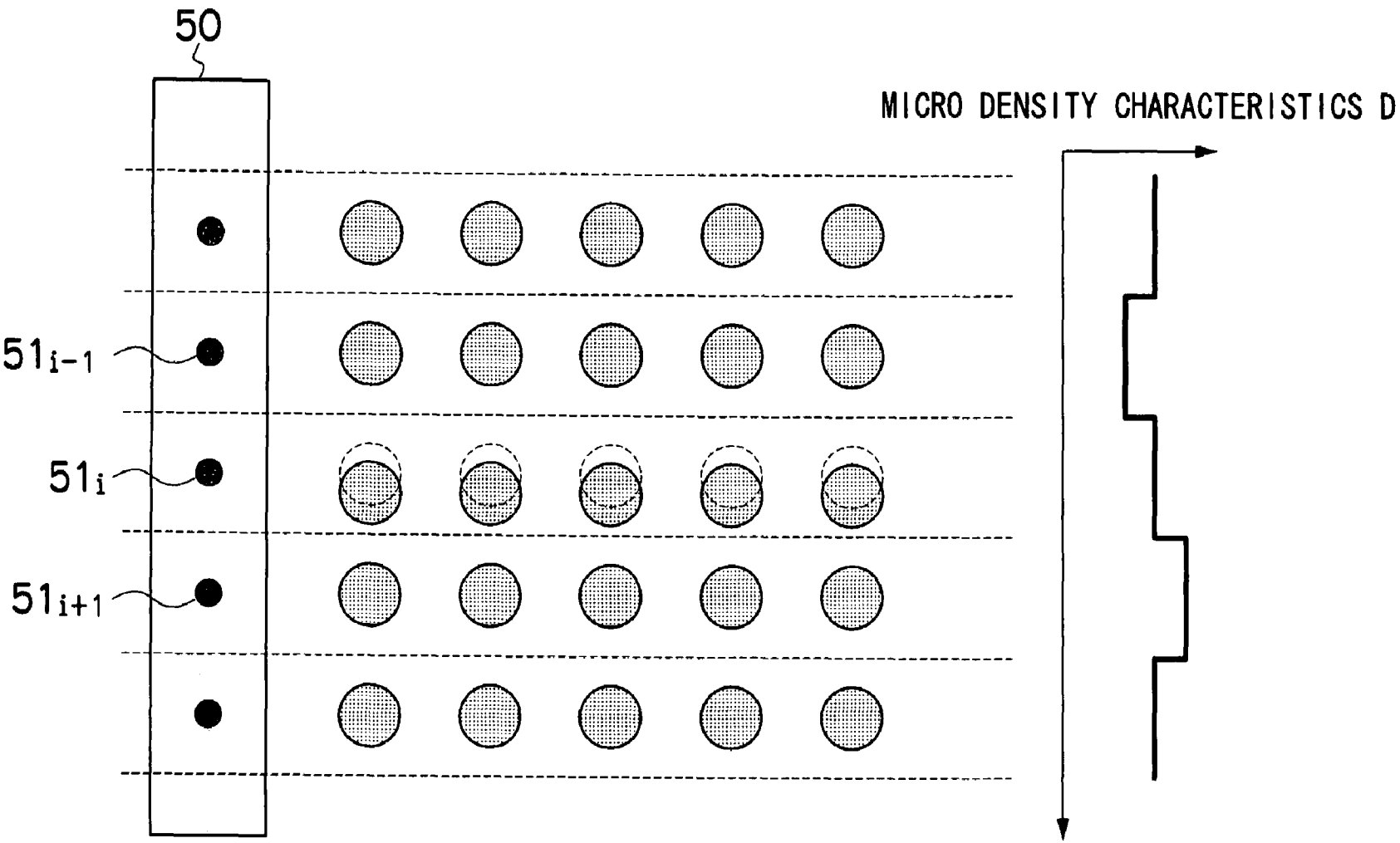
FIG. 25 is an illustrative diagram showing an example of landing position errors caused by non-uniformity of density.

For example, as shown in FIG. 25, it is supposed that the i-th nozzle $\mathbf{51}_i$ of the print head 50 has the landing position errors similar to those shown in FIG. 19. In this case, as described above, the density profiles of the print areas corresponding to the two adjacent nozzles $\mathbf{51}_{i-1}$ and $\mathbf{51}_{i+1}$ are also affected. The micro density profile acquired by the method described above is shown on the right-hand side of FIG. 25. This micro density profile is the same as that shown in FIG. 24. In other words, in the area corresponding to the nozzle $\mathbf{51}_{i+1}$ which is adjacent to nozzle $\mathbf{51}_i$, the density is affected to increase, whereas in the area corresponding to the nozzle $\mathbf{51}_{i-1}$, the density is affected to decrease.

Figure 26:
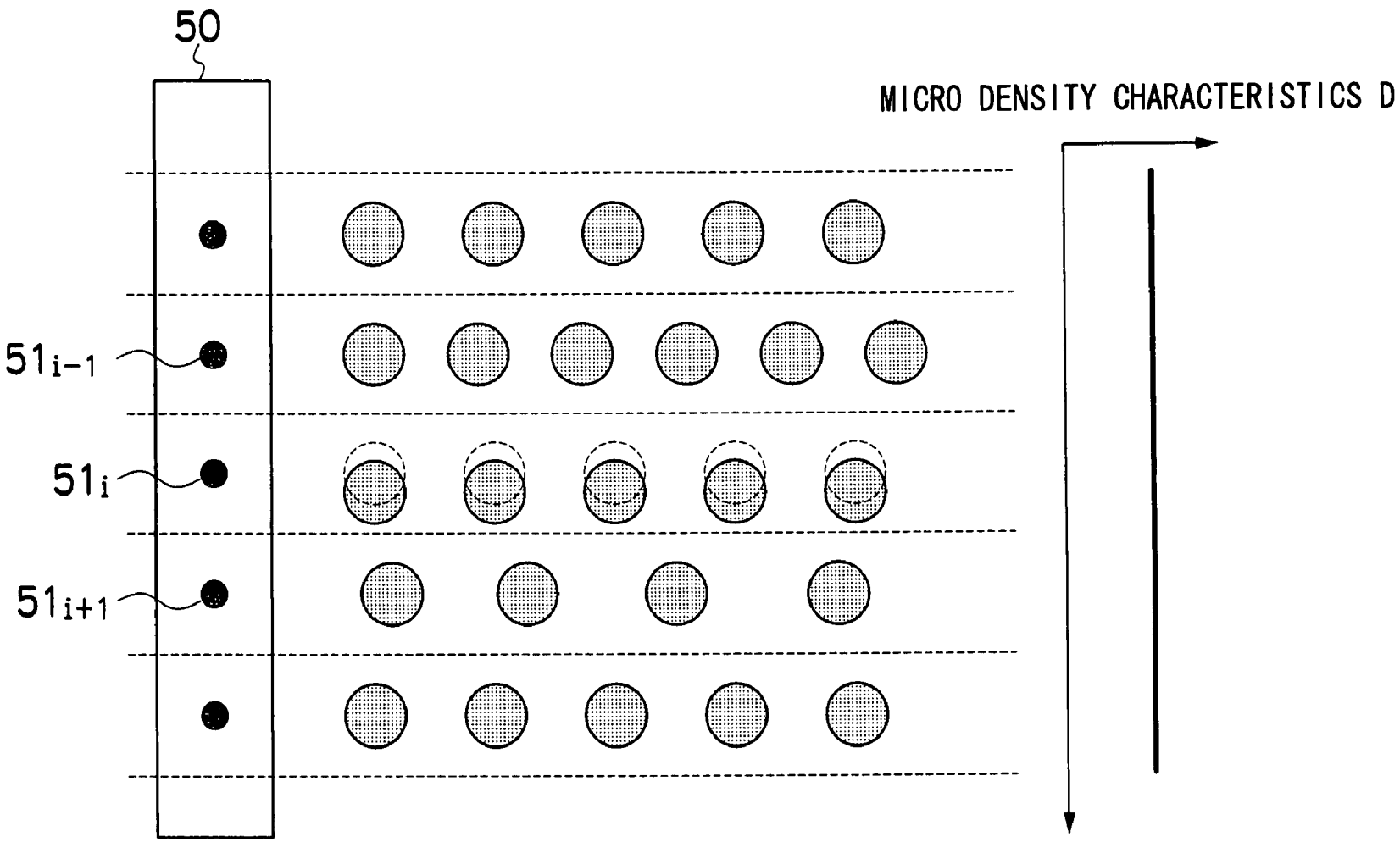
FIG. 26 is an illustrative diagram showing the results of performing compensation with respect to the example in FIG. 25.

FIG. 26 shows the result of printing at a droplet ejection rate that has been compensated in accordance with these micro density characteristics, in the adjacent nozzles $\mathbf{51}_{i+1}$ and $\mathbf{51}_{i-1}$ which are affected by the nozzle $\mathbf{51}_i$. As shown in FIG. 26, by performing compensation in such a manner that the droplet ejection rate of the nozzle $\mathbf{51}_{i+1}$ is reduced and the droplet ejection rate of the nozzle $\mathbf{51}_{i-1}$ is increased, the density profile becomes flattened as shown by the micro density characteristics on the right-hand side of FIG. 26, and hence the non-uniformity of density is compensated and the linear non-uniformity is eliminated.

In the related art, it is difficult to obtain such a micro density characteristics, and therefore it is not possible to carry out this kind of the compensation of non-uniformity of density.

Furthermore, in the present embodiment, as described above, the density profile is acquired at a resolution of at least twice as high as the nozzle resolution, and desirably at a resolution that is an integer (at least two) times as high as the nozzle resolution, and the micro density characteristics are determined by averaging within each area after carrying out the low-pass filtering process. Therefore, non-uniformity arising due to landing position errors can be compensated to a high degree of accuracy.

Furthermore, by setting the cut-off frequency of the low-pass filter to the reciprocal of the approximate nozzle pitch, in particular, it becomes possible to compensate non-uniformity caused by landing position errors, to a high degree of accuracy.

Next, a further embodiment of the present invention will be described. In this embodiment, the present invention is applied to the case of a multiple-value printer which is capable of modifying the dot size by means of the drive waveform and ejecting droplets to form dots of different sizes.

Figure 27:
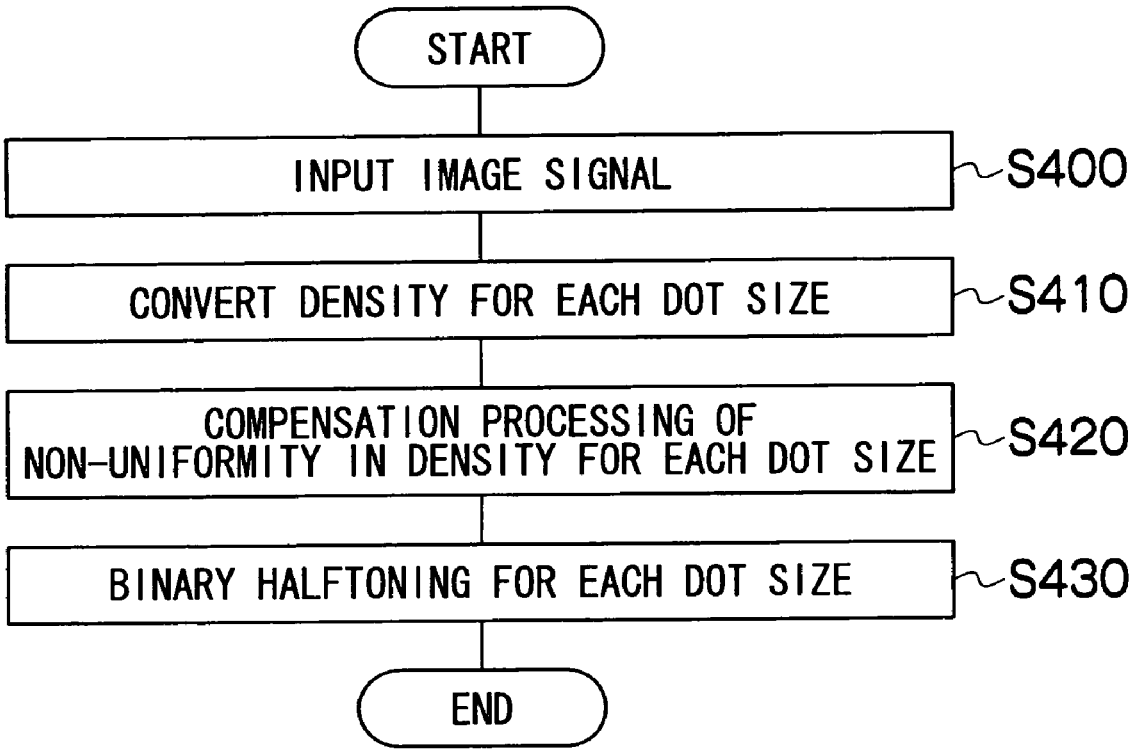
FIG. 27 is a flowchart showing a sequence of image processing relating to a further embodiment of the present invention.

FIG. 27 is a flowchart showing a sequence of the image processing according to the present embodiment. In this embodiment, there is no particular restriction on the number of different dot sizes, and here, a four-value printer which is capable of ejecting (printing) three types of dots, a large dot, a medium dot and a small dot, and ejecting (printing) no dot, is described as an example.

The steps S400 to S430 in FIG. 27 correspond to the steps S100 to S130 in FIG. 8 respectively. The present embodiment only differs from the embodiment described above in that: the signal is converted to a droplet ejection rate signal with respect to each size of the dots, namely, large, medium and small, when the density is converted; different micro density characteristics are obtained for each of the dot sizes, large, medium and small respectively; and compensation is carried out in accordance with these characteristics. The other processes are the same as that described in foregoing embodiment.

In the case of a multiple-value printer of this kind, large, medium and small dots are ejected from the same nozzle. Hence, in the related art, the nozzle is taken to have the same landing position errors, regardless of the dot size. However, as a result of the experimentation carried out by the present inventor, it is discovered that change in the landing position error occurs with variation in the dot size. Therefore, if, for example, the droplet ejection for a small dot is compensated on the basis of the landing position errors relating to a large dot, then it is difficult to compensate non-uniformity suitably. Therefore, it is possible to suitably compensate the non-uniformity of density, even in cases of this kind, by measuring the landing position errors independently for large, medium and small dots, and obtaining the micro density characteristics.

More specifically, at step S400 in FIG. 27, an image signal containing density graduation information is input to the ink-jet recording apparatus 10. Then, at step S410, density conversion (inverse conversion of the reference density characteristics) is carried out for each of the large, medium and small dots, and the characteristics are converted into droplet ejection rate information for large dots, medium dots and small dots respectively. In this case, similarly to the embodiment described above, UCR (under color removal) processing and processing for distribution to light inks, such as LC and LM, are also carried out simultaneously.

Thereupon, at step S420, the compensation processing of non-uniformity of density is carried out respectively for the large dots, medium dots and small dots. At the next step, S430, the droplet ejection rate signals which have been subjected to the compensation of non-uniformity of density in this way undergo halftoning, such as error diffusion, respectively for the large dots, medium dots and small dots, thereby converting the droplet ejection rate signals into binary signals.

Figure 28:
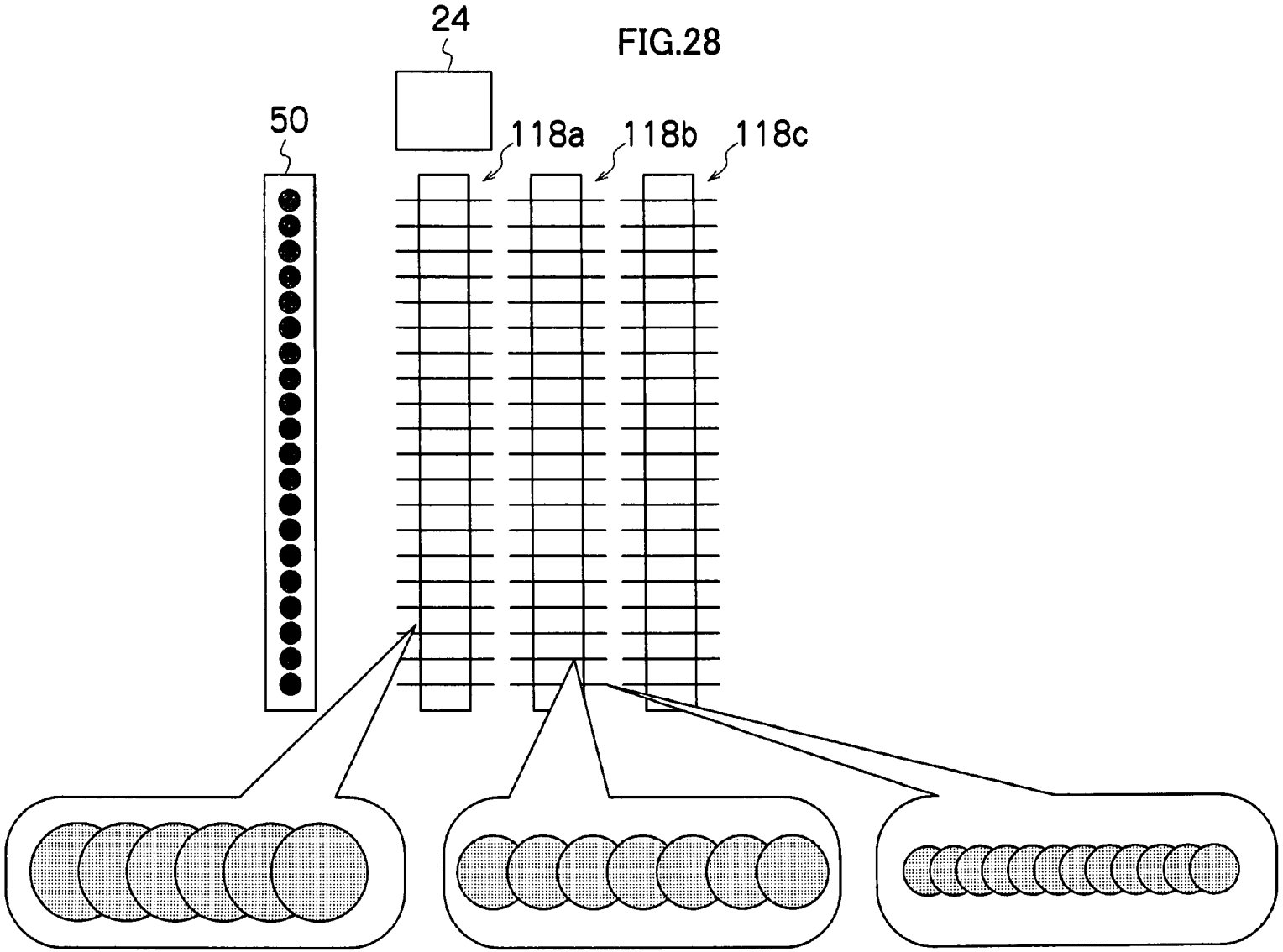
FIG. 28 is an illustrative diagram showing a method of measuring landing position errors in the embodiment shown in FIG. 27.
Figure 29A:
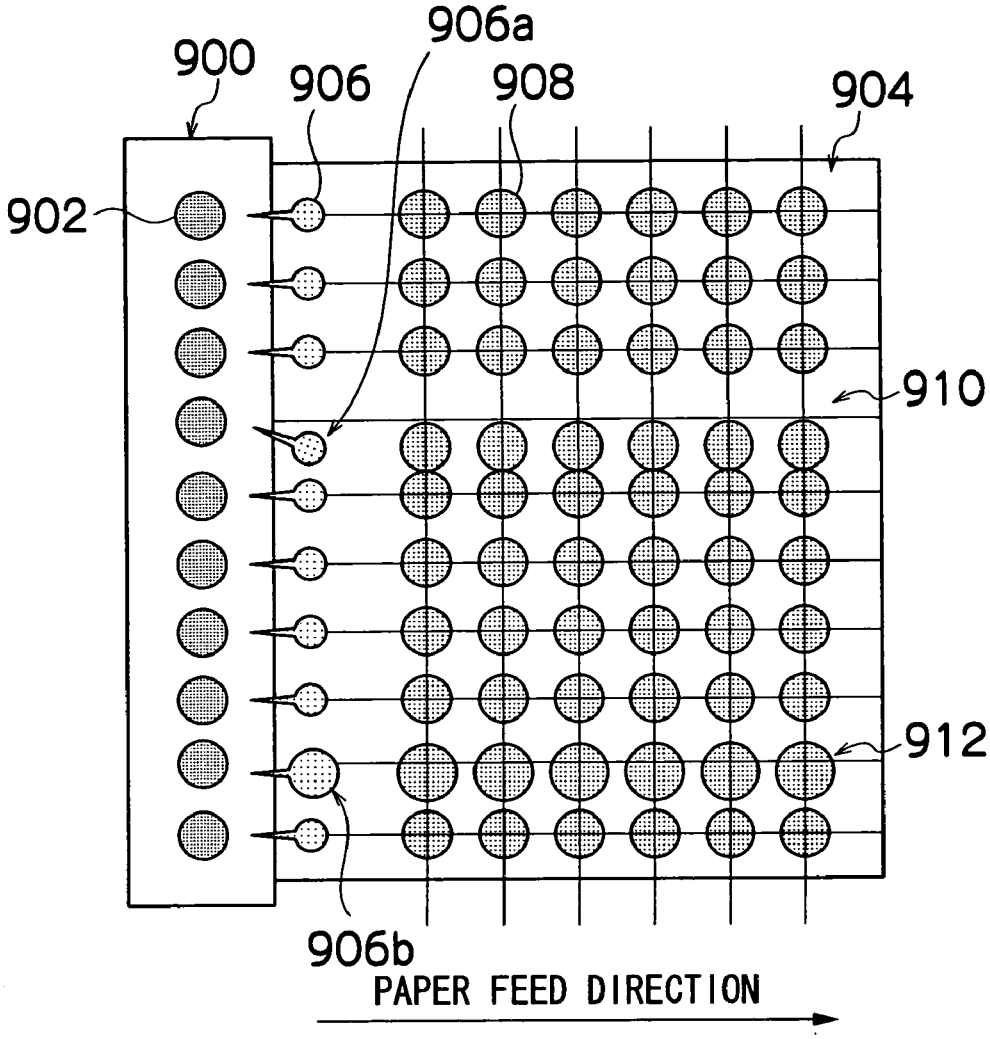
FIG. 29A is an illustrative diagram showing a cause of linear non-uniformity.
Figure 29B:
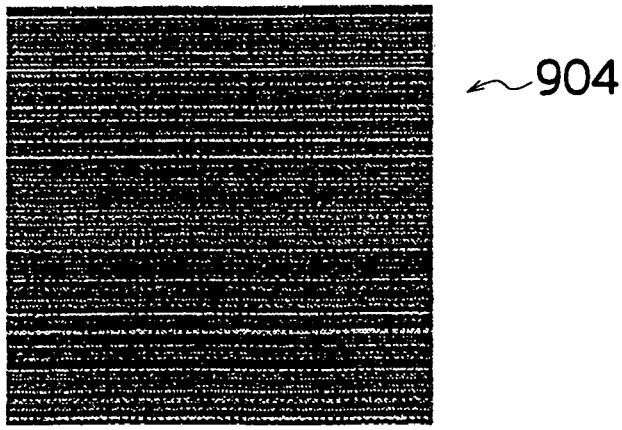
FIG. 29B is an illustrative diagram showing an example of linear non-uniformity.
Figure 30:
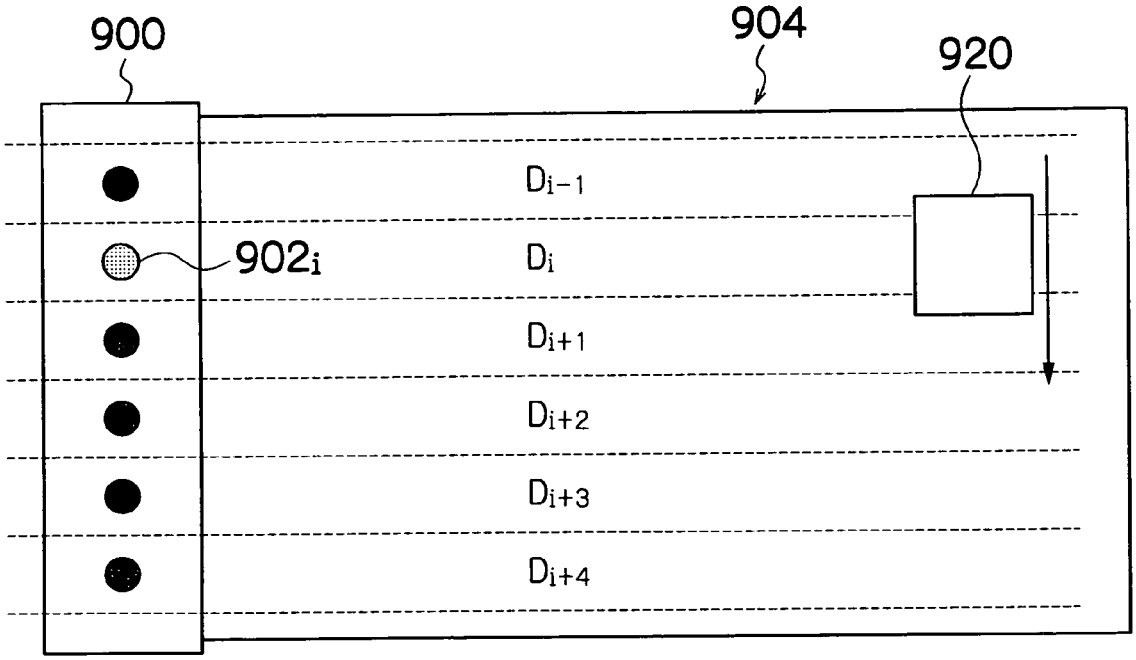
FIG. 30 is an illustrative diagram showing the arrangement of nozzles and recording paper.
Figure 31:
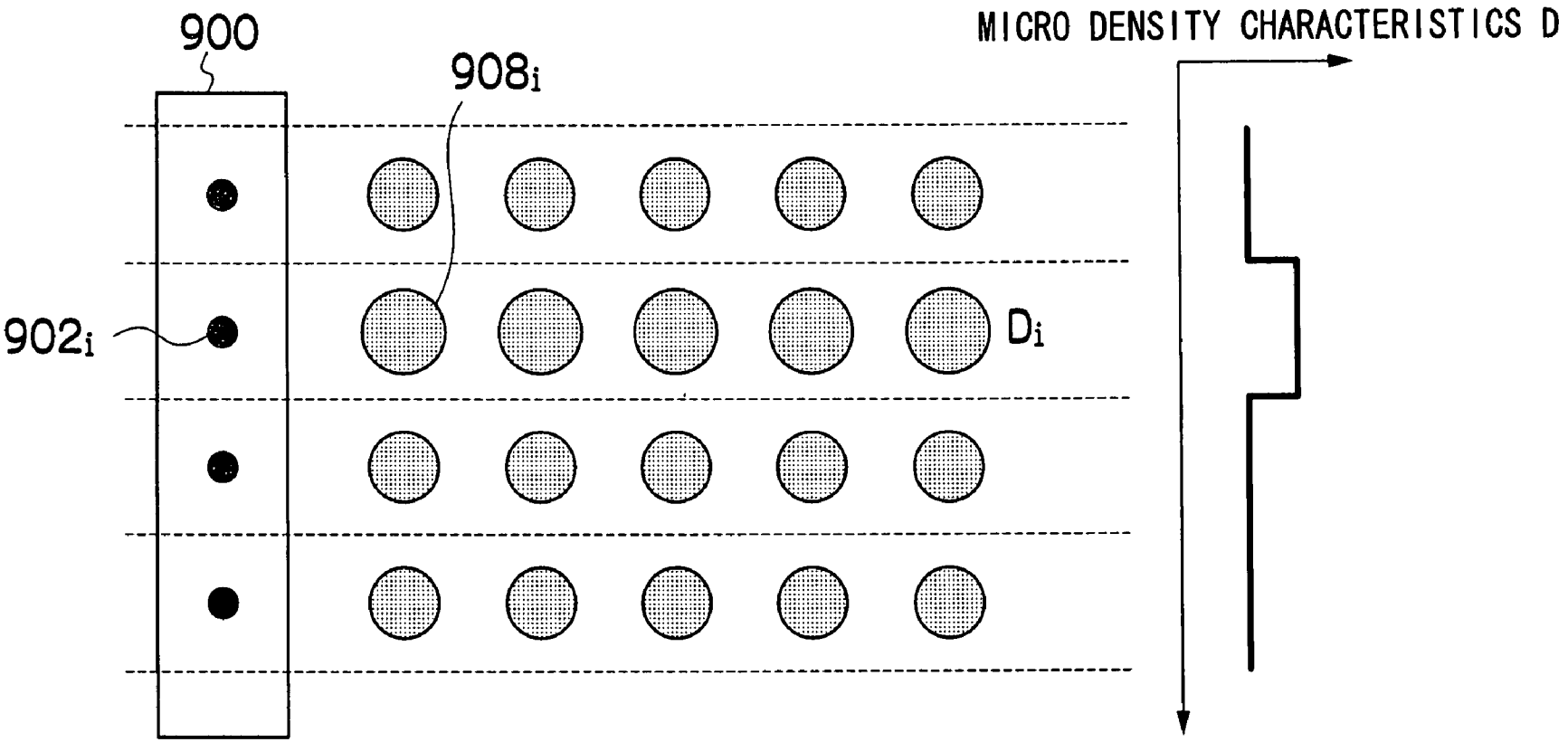
FIG. 31 is an illustrative diagram showing ejection volume errors.
Figure 32:
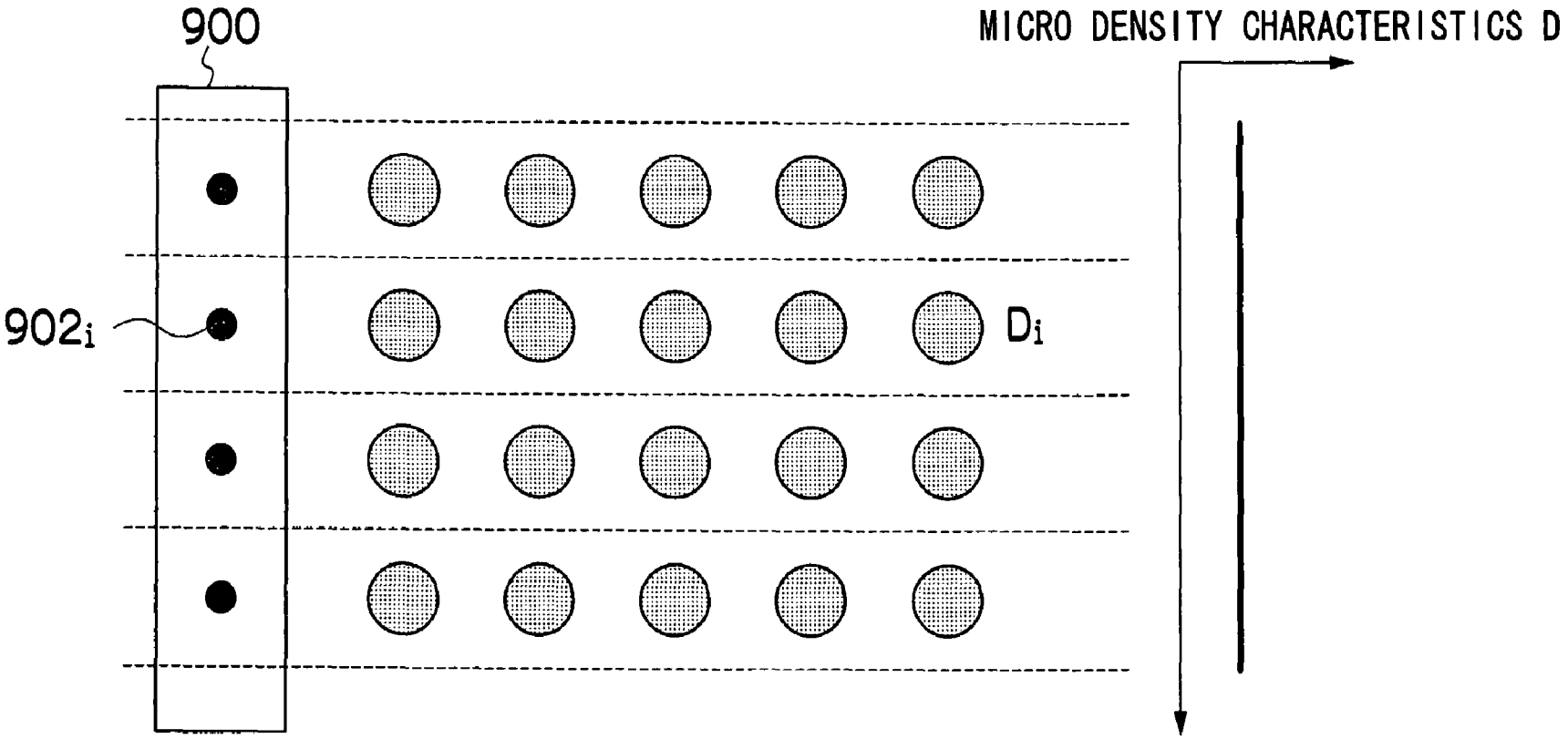
FIG. 32 is an illustrative diagram showing results according to a compensation method of related art.
Figure 33:
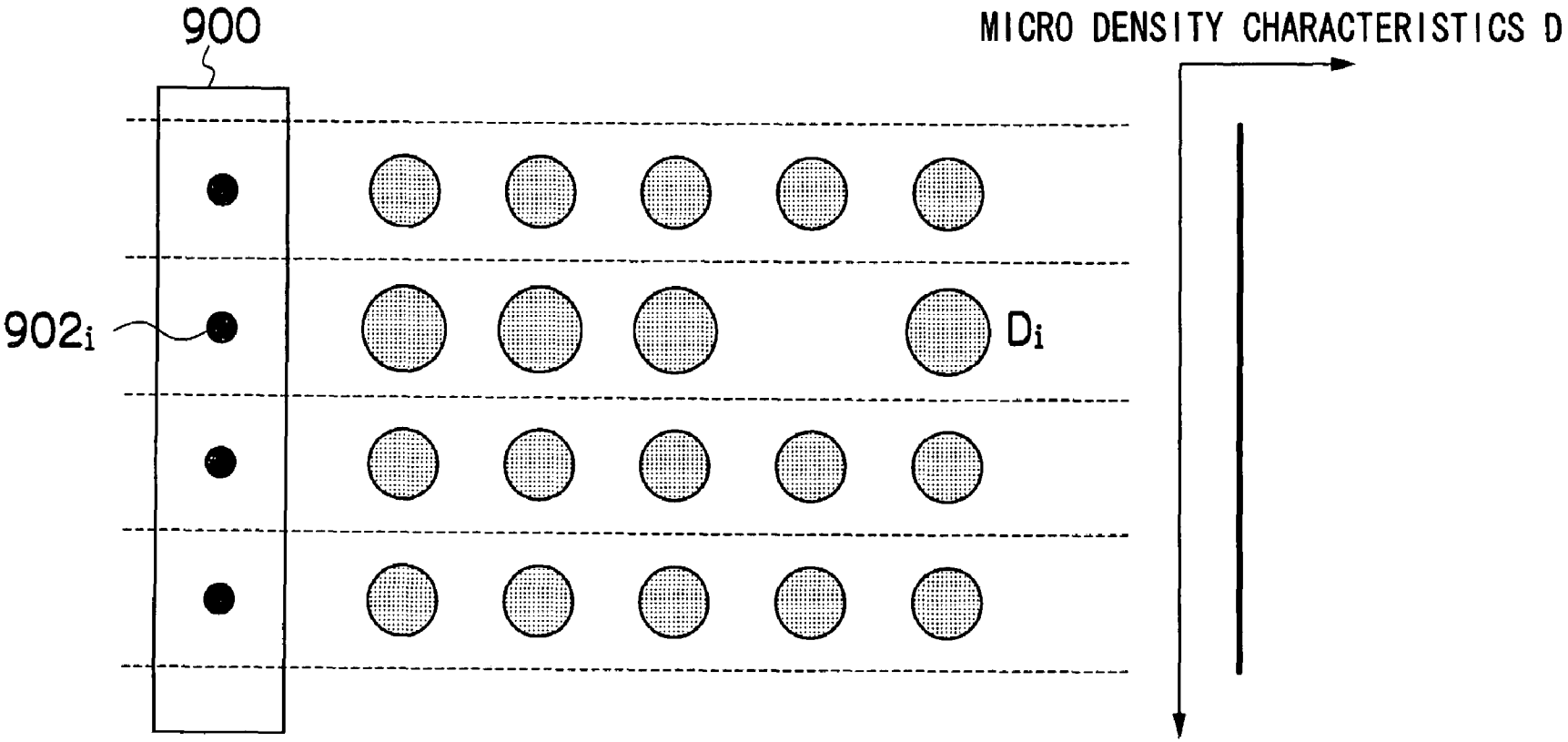
FIG. 33 is an illustrative diagram showing compensation based on control of the droplet ejection rate.
Figure 34:
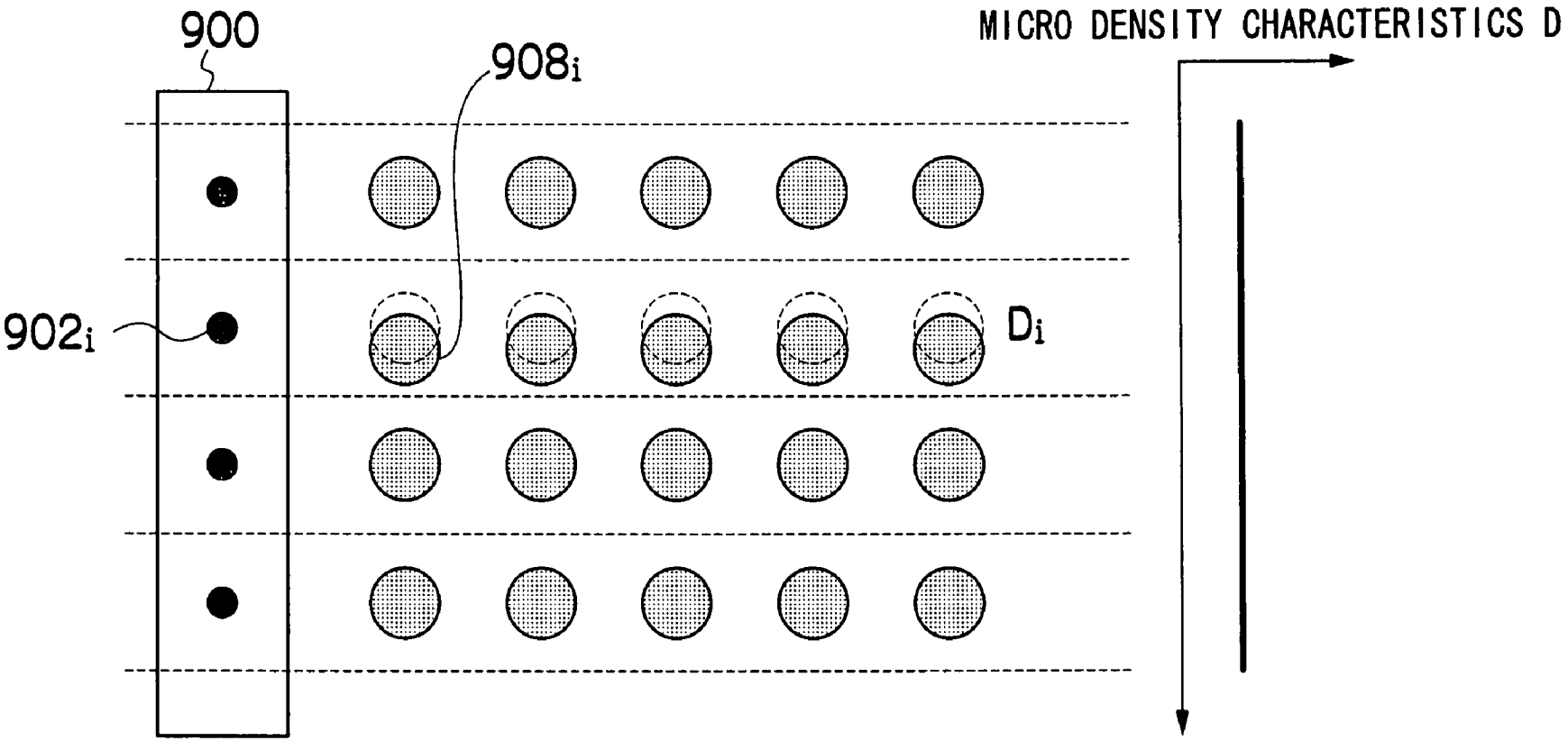
FIG. 34 is an illustrative diagram showing the occurrence of linear non-uniformity due to landing position errors.
Figure 35:
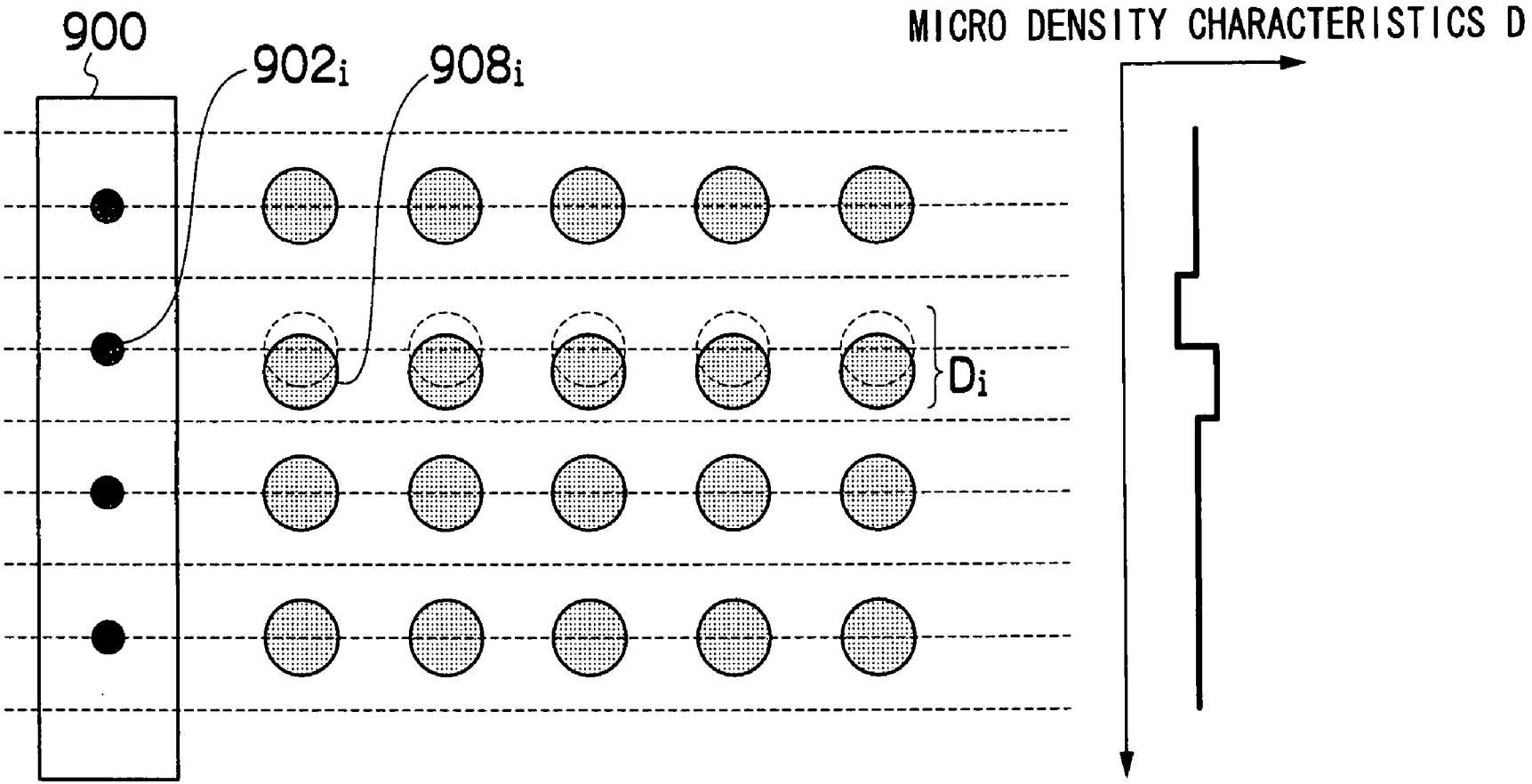
FIG. 35 is an illustrative diagram showing the situation of acquiring micro density characteristics.
Figure 36:
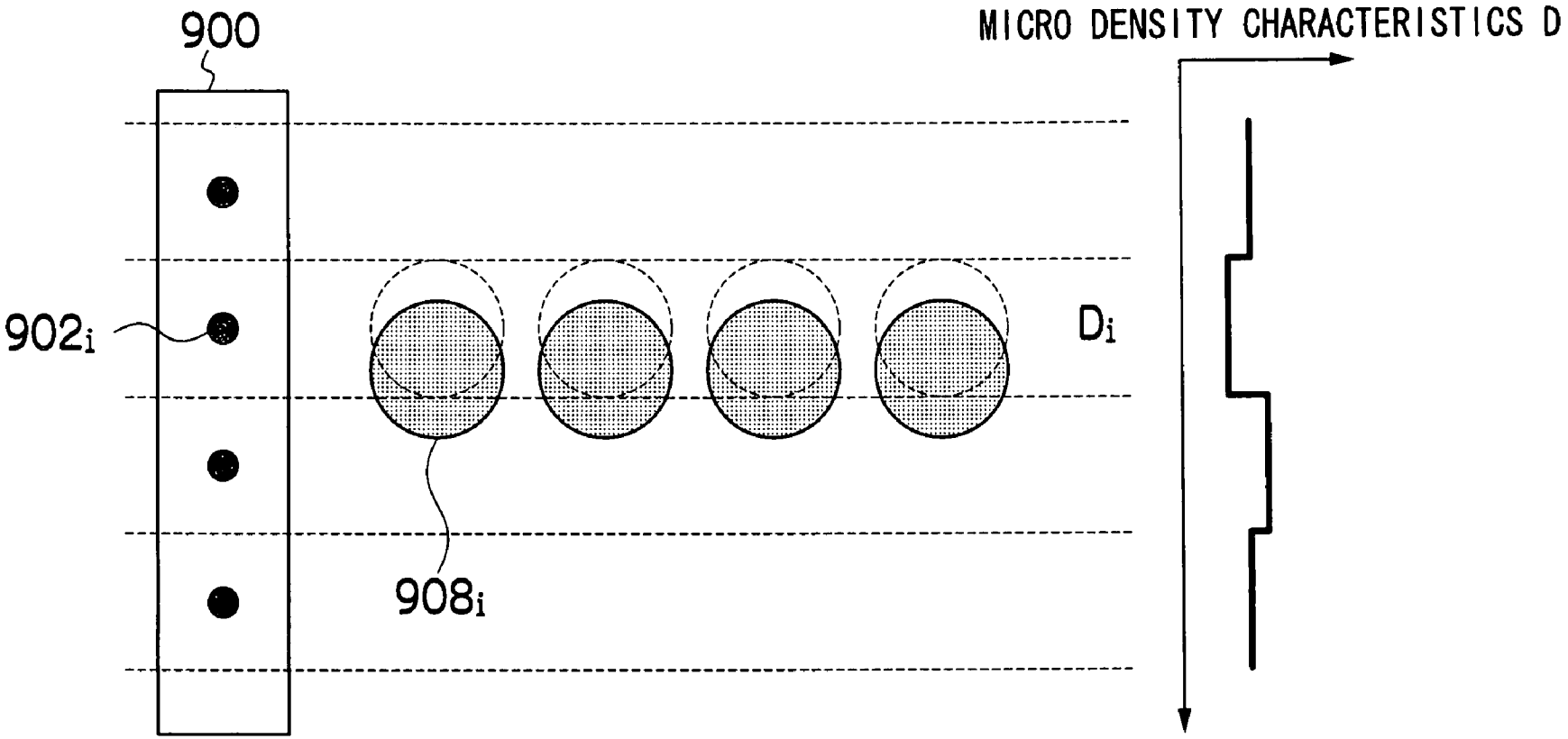
FIG. 36 is an illustrative diagram showing an example of landing position errors in which dots project into the print area of another nozzle.
Figure 37:
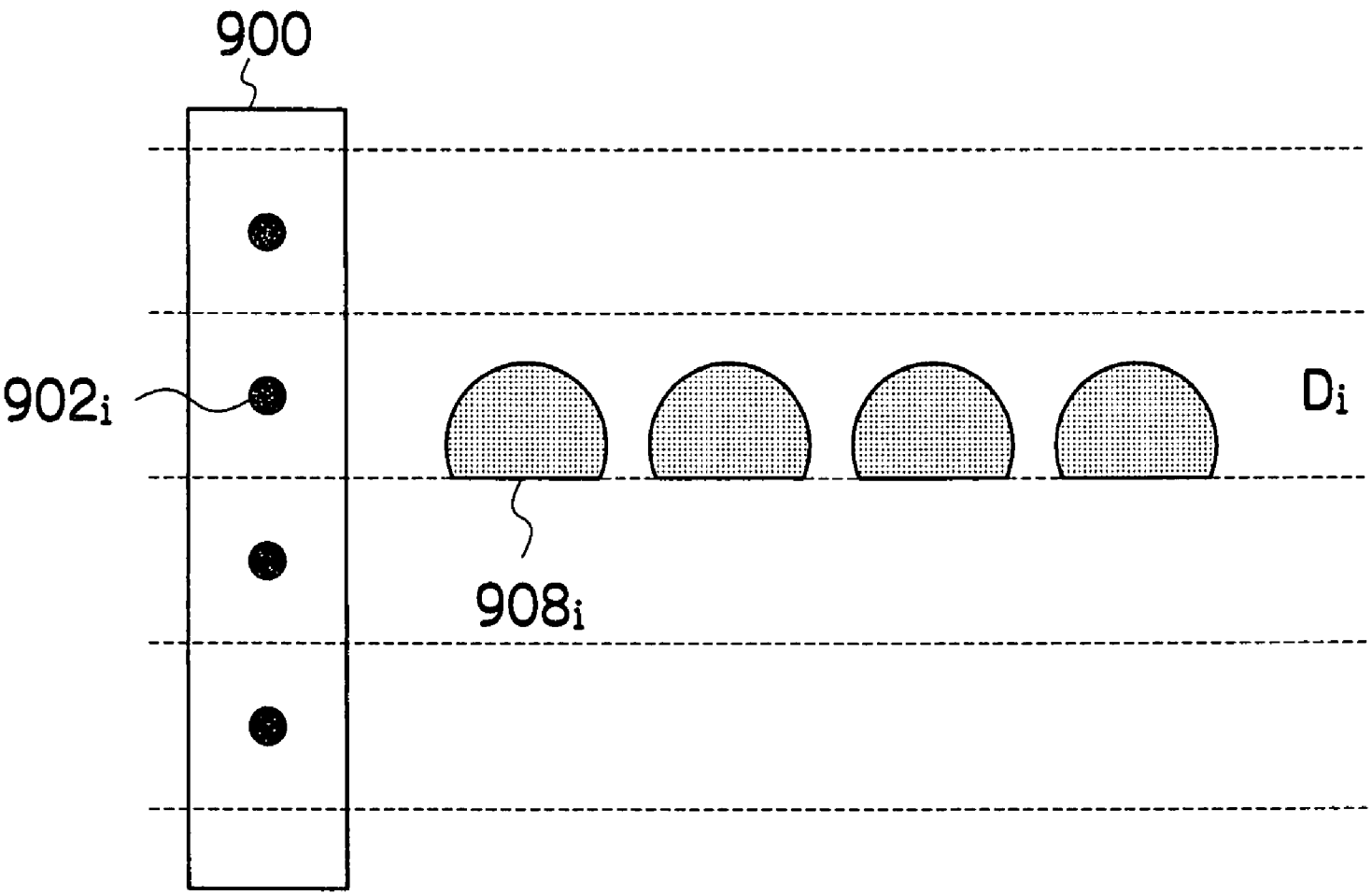
FIG. 37 is also an illustrative diagram showing an example of landing position errors in which dots project into the print area of another nozzle.

In determining the micro density characteristics with respect to each of large, medium and small dots, a test pattern is created and measured with respect to each large, medium and small dots, in order to measure the landing position errors with respect to each dot size. For example, as shown in FIG. 28, droplets are ejected from the print head 50 to form a test pattern 118*a* for large dots, a test pattern 118*b* for medium dots, and a test pattern 118*c* for small dots, and then the optical density of the test patterns is measured by the optical sensor such as the print determination unit 24.

In this way, the micro density characteristics are acquired for each dot size, in such a manner that the signals are compensated accordingly. Therefore, it is possible to achieve the suitable compensation of the different landing position errors corresponding to each dot size, and hence band-shaped non-uniformity caused by non-uniform density can be eliminated in this case also.

Although the image recording method and the image recording apparatus according to the present invention have been described in detail above, the present invention is not limited to the aforementioned embodiments. It is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image recording apparatus which records an image by ejecting ink onto a recording medium from a print head having a plurality of nozzles while moving the print head and the recording medium relatively to each other, the image recording apparatus comprising:

a memory device which stores reference density characteristics obtained by measuring a prescribed test pattern formed on the recording medium by means of the nozzles;

a density characteristic acquiring device which acquires density characteristics of print areas corresponding to the nozzles;

a compensation device which compensates a droplet ejection rate signal of each of the nozzles so that the density characteristics acquired by the density characteristic acquiring device coincide with the reference density characteristics; and a quantization device which quantizes each droplet ejection rate signal compensated by the compensation device.

2. The image recording apparatus as defined in claim 1, wherein, if a landing position error occurs in the print area corresponding to a particular nozzle of the nozzles, then each droplet ejection rate signal is compensated so as to reduce a droplet ejection rate in respect of the nozzle corresponding to the print area having the density characteristics which increase due to effect of the landing position error and increase a droplet ejection rate in respect of the nozzle corresponding to the print area having the density characteristics which decrease due to effect of the landing position error, so that non-uniformity of density caused by the landing position error is reduced.

3. The image recording apparatus as defined in claim 1, wherein the density characteristic acquiring device includes:

an acquisition device which acquires density data at a resolution of a real number times as high as a nozzle resolution of the nozzles, the real number being at least two;

a filtering process device which carries out a filtering process with respect to the density data acquired by the acquisition device; and an averaging process device which averages the density data filtered by the filtering process device.

4. The image recording apparatus as defined in claim 3, wherein the filtering process device carries out the filtering process with a low-pass filter having a cut-off frequency of substantially equal to the nozzle resolution.

5. An image recording apparatus which is capable of changing a dot size of each of dots formed by a plurality of nozzles when an image is recorded by ejecting ink onto a recording medium from a print head having the nozzles while moving the print head and the recording medium relatively to each other, the image recording apparatus comprising:.

a memory device which stores reference density characteristics with respect to each dot size which are previously obtained by measuring a prescribed test pattern formed on the recording medium by means of the nozzles;

a density characteristic acquiring device which acquires density characteristics of print areas corresponding to the nozzles, with respect to each dot size;

a compensation device which compensates a droplet ejection rate signal of each of the nozzles so that the density characteristics acquired by the density characteristic acquiring device coincide with the reference density characteristics, with respect to each dot size; and a quantization device which quantizes each droplet ejection rate signal which is compensated by the compensation device.

6. An image recording method of recording an image by ejecting ink onto a recording medium from a print head having a plurality of nozzles while moving the print head and the recording medium relatively to each other, the image recording method comprising the steps of:

storing reference density characteristics obtained by measuring a prescribed test pattern formed on the recording medium by means of the nozzles;

acquiring density characteristics of print areas corresponding to the nozzles;

compensating a droplet ejection rate signal of each of the nozzles so that the acquired density characteristics of the print areas corresponding to the nozzles coincide with the reference density characteristics; and quantizing the compensated droplet ejection rate signal.

7. The image recording method as defined in claim 6, wherein the density characteristics of the print areas corresponding to the nozzles are calculated by measuring density data at a resolution of a real number times as high as a nozzle resolution of the nozzles, the real number being at least two, filtering the measured density data, and then averaging the filtered density data.

* * * * *